US011235571B2

(12) United States Patent
Asamoto et al.

(10) Patent No.: US 11,235,571 B2
(45) Date of Patent: Feb. 1, 2022

(54) LIQUID DISCHARGE APPARATUS AND DISPLAY CONTROL METHOD IN LIQUID DISCHARGE APPARATUS

(71) Applicant: SEIKO EPSON CORPORATION, Tokyo (JP)

(72) Inventors: Katsuya Asamoto, Matsumoto (JP); Tsuneyuki Sasaki, Matsumoto (JP); Takehito Washizawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/829,352

(22) Filed: Mar. 25, 2020

(65) Prior Publication Data

US 2020/0307186 A1 Oct. 1, 2020

(30) Foreign Application Priority Data

Mar. 26, 2019 (JP) ..... JP2019-057887

(51) Int. Cl.
*B41J 2/045* (2006.01)
*B41J 2/165* (2006.01)
*B41J 3/46* (2006.01)

(52) U.S. Cl.
CPC ..... *B41J 2/04566* (2013.01); *B41J 2/0451* (2013.01); *B41J 2/04553* (2013.01); *B41J 2/04573* (2013.01); *B41J 3/46* (2013.01)

(58) Field of Classification Search
CPC .. B41J 2/04566; B41J 2/04553; B41J 2/0451; B41J 2/04573; B41J 2/16517; B41J 3/46
See application file for complete search history.

(56) References Cited

U.S. PATENT DOCUMENTS

2002/0101472 A1* 8/2002 Tsuboi ..... B41J 2/16526 347/35
2004/0041892 A1* 3/2004 Yoneyama ..... B41J 11/002 347/102
2008/0238982 A1 10/2008 Kaneko et al.
2016/0263923 A1* 9/2016 Tsubota ..... B41J 11/0015

FOREIGN PATENT DOCUMENTS

JP 2006-150873 6/2006
JP 2015-178179 10/2015

* cited by examiner

*Primary Examiner* — Matthew Luu
*Assistant Examiner* — Kendrick X Liu
(74) *Attorney, Agent, or Firm* — Workman Nydegger

(57) ABSTRACT

A liquid discharge apparatus is provided that includes a discharge unit configured to discharge a liquid onto a medium, a support portion configured to support a portion of the medium, the liquid being discharged from the discharge unit onto the portion of the medium, a housing including therein the discharge unit, a humidity detection unit configured to detect a humidity, and a display control unit configured to display an indication prompting adjustment of a temperature or humidity when the humidity detection unit detects a humidity less than a lower limit value, and configured to display an indication prompting adjustment of a temperature or humidity when the humidity detection unit detects a humidity exceeding an upper limit value greater than the lower limit value.

6 Claims, 12 Drawing Sheets

LIQUID DISCHARGE APPARATUS AND DISPLAY CONTROL METHOD IN LIQUID DISCHARGE APPARATUS

The present application is based on, and claims priority from JP Application Serial Number 2019-057887, filed Mar. 26, 2019, the disclosure of which is hereby incorporated by reference herein in its entirety.

BACKGROUND

1. Technical Field

The present disclosure relates to a liquid discharge apparatus including a discharge unit configured to discharge a liquid such as ink onto a medium such as a paper, and a display control method for the liquid discharge apparatus.

2. Related Art

For example, JP 2015-178179 A discloses a liquid injection apparatus such as an inkjet printer configured to discharge a liquid such as ink onto a medium such as a paper to perform printing. The liquid injection apparatus, while sending environmental information containing temperature and humidity to a server, receives, from the server, a first estimation model for estimating a recommended time for checking nozzles generated by the server. The liquid injection apparatus computes a recommended time based on the first estimation model, performs nozzle checking at the recommended time, and urges the user to perform cleaning. Thereafter, when the user does not perform cleaning within a predetermined preliminary period, the liquid injection apparatus forcibly performs cleaning.

Unfortunately, the liquid injection apparatus described in JP 2015-178179, when the recommended time is reached, causes the user to perform cleaning by a manual operation, or the liquid discharge apparatus forcibly performs cleaning after the subsequent preliminary period passes, and thus, the frequency of performing the cleaning is left to the environment at that time. For example, when the humidity becomes excessively low, foreign substances such as dust and fluff become easily suspended in the air. An air containing the foreign substances suspended in the air, when taken into the housing, facilitates the occurrence of nozzle clogging in the discharge unit. In this case, the recommended time is advanced and the frequency of the cleaning increases. A higher cleaning frequency leads to increased consumption of liquid such as ink that is not utilized for printing, and reduced productivity. Further, the liquid injection apparatus described in JP 2015-178179 A is only directed to the printing failure due to nozzles, and there is no consideration for the printing failure due to medium postures such as wrinkles and floating of a medium, which easily occur when the humidity is excessively high. For example, although managing the environment including temperature or humidity can suppress increase in frequencies of cleaning caused by nozzle clogging or an occurrence of wrinkles or the like in the medium, the user does not have any means to know that the humidity has deviated from the range suitable for printing. In addition, because the liquid injection apparatus is operated in a recommended environment, there is a case when the operator manages temperature and humidity, and this kind of managing temperature and humidity is troublesome and moreover, causes the burden of the operator.

SUMMARY

A liquid discharge apparatus for solving the above-described problems includes a transport unit configured to transport a medium, a discharge unit configured to discharge a liquid onto the medium, a support portion that supports a portion of the medium, the liquid being discharged from the discharge unit onto the portion of the medium, a housing including therein the discharge unit, a humidity detection unit configured to detect a humidity, and a display control unit configured to display an indication prompting adjustment of a temperature or humidity when the humidity detection unit detects a humidity less than a first predetermined value, and configured to display an indication prompting adjustment of a temperature or humidity when the humidity detection unit detects a humidity exceeding a second predetermined value greater than the first predetermined value.

A display control method for a liquid discharge apparatus for resolving the above-described issue is a display control method for the liquid discharge apparatus including a transport unit configured to transport a medium, a discharge unit configured to discharge a liquid onto the medium, and a humidity detection unit configured to detect a humidity, the liquid discharge apparatus displaying information corresponding to the humidity, the display control method including a humidity detection step for detecting a humidity by the humidity detection unit, a first display step for displaying an indication prompting adjustment of a temperature or humidity when the humidity detection unit detects a humidity less than a first predetermined value, and a second display step for displaying an indication prompting adjustment of a temperature or humidity when the humidity detection unit detects a humidity exceeding a second predetermined value greater than the first predetermined value.

DESCRIPTION OF EXEMPLARY EMBODIMENTS

First Embodiment

Hereinafter, a liquid discharge apparatus according to the first embodiment will be described with reference to the accompanying drawings.

Figure 1:
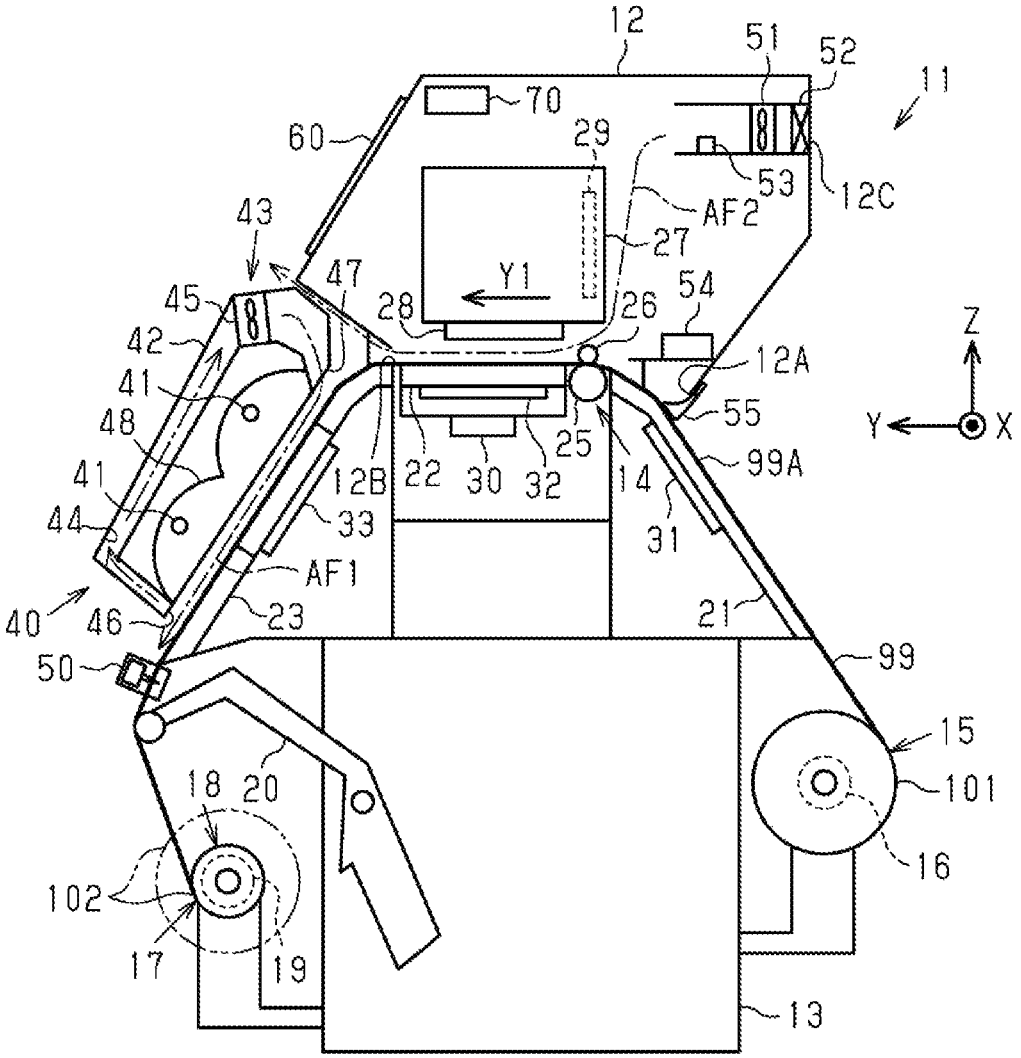
FIG. 1 is a cross-sectional view illustrating a liquid discharge apparatus according to a first embodiment.

A liquid discharge apparatus 11 illustrated in FIG. 1 is, for example, an inkjet-type printer that performs printing of an image such as characters and pictures on a medium such as a paper by discharging liquid such as ink. The liquid discharge apparatus 11 includes a housing 12 and a base stage 13 for supporting the housing 12. The housing 12 is an external packaging of the liquid discharge apparatus 11 that includes an openable and closable cover (not illustrated). Note that in FIG. 1 and the like, three virtual axes orthogonal to one another are referred to as X axis, Y axis, and Z axis, assuming that the liquid discharge apparatus 11 is placed on a horizontal surface. The X axis is a virtual axis parallel to the scanning direction of a discharge unit 28 that will be described later, and the Y-axis is a virtual axis parallel to the transport direction of a medium 99 in the printing region. Further, the Z-axis is a virtual axis parallel to the vertical direction.

The liquid discharge apparatus 11 includes a transport unit 14 configured to transport the medium 99. The transport unit 14 is provided inside the housing 12, and is configured to transport the medium 99 along a predetermined transport path. The liquid discharge apparatus 11 includes a feeding unit 15 configured to support a roll body 101 that the medium 99 to which a liquid is to be discharged is wound a plurality of times. The feeding unit 15 is attached to the base stage 13, for example, and supports the roll body 101 in a rotatable state. The feeding unit 15 includes a feeding motor 16 that is driven when the roll body 101 is rotated in the feeding direction. The transport unit 14 is configured to transport the medium 99 in an elongated form, which the feeding unit 15 fed out from the roll body 101.

The liquid discharge apparatus 11 includes the discharge unit 28 configured to discharge a liquid onto the medium 99. The liquid discharge apparatus 11 of this example is a serial printer in which the discharge unit 28 scans with respect to the medium 99. Accordingly, the discharge unit 28 is provided at the lower portion of a carriage 27 configured to move. The discharge unit 28 is an inkjet-type recording head. The region where the discharge unit 28 can discharge a liquid onto the medium 99 is referred to as printing region, where the direction in which the medium 99 is transported in the printing region is referred to as transport direction Y1. The carriage 27 reciprocatively moves along the X axis intersecting the transport direction Y1 of the medium 99, with respect to the medium 99 being transported. The discharge unit 28, during the movement of the carriage 27, discharges a liquid onto the medium 99 to cause an image and the like to be printed on the medium. The liquid discharge apparatus 11 includes the discharge unit 28 and the carriage 27 inside the housing 12. Note that the liquid discharge apparatus 11 may be a line printer in which the discharge units 28 are arranged in an elongated form that can discharge a liquid in the range across the width of the medium 99, which does not include the carriage 27.

As illustrated in FIG. 1, the liquid discharge apparatus 11 includes a winding unit 17 configured to wind the medium 99, to which a liquid is discharged from the discharge unit 28, in a rolled form. The winding unit 17 is attached to, for example, the base stage 13. The winding unit 17 includes a reel mechanism 18 configured to wind the medium 99 on which printing is performed by the discharge of liquid, as a roll body 102. The reel mechanism 18 includes a winding motor 19 that is driven when winding the roll body 102.

The liquid discharge apparatus 11 includes a tension bar 20 that applies tension to the medium 99. The tension bar 20 applies tension to the medium 99 by coming into contact with the medium 99. Applying tension to the medium 99 with the tension bar 20 improves the transport accuracy of the medium 99. The tension bar 20 comes in contact with, in the medium 99, a portion that passed through a drying device 40 and a portion before being wound around the winding unit 17. The tension bar 20 is attached to, for example, the base stage 13 in a pivotable manner. The tension bar 20, by changing the weight provided on the opposite side of the pivot fulcrum, can adjust the magnitude of the tension exerted on the medium 99.

The liquid discharge apparatus 11 includes an upstream support portion 21, a support portion 22, and a downstream support portion 23 that constitute the transport path of the medium 99. The upstream support portion 21, the support portion 22, and the downstream support portion 23 support the medium 99 being transported by the transport unit 14. The upstream support portion 21, the support portion 22, and the downstream support portion 23 are arranged in that order from the upstream to the downstream of the transport path. The support portion 22 is a platen for supporting a portion of the medium 99, to which a liquid is discharged by the discharge of the discharge unit 28. The support portion 22 is located inside the housing 12. Specifically, the upstream support portion 21, which configures the upstream portion of the transport path, supports the medium 99 at the portion from the feeding unit 15 to the transport unit 14. The support portion 22, which configures the middle stream portion of the transport path, supports the medium 99 at the portion downstream of the transport unit 14, which faces the discharge unit 28. The downstream support portion 23, which configures the downstream portion of the transport path, supports a portion, to which printing has been performed, of the medium 99 transported downstream by the transport unit 14, and to which a liquid discharged from the discharge unit 28 adheres. In the example illustrated in FIG. 1, the support portion 22 is horizontally disposed, and the upstream support portion 21 and the downstream support portion 23, which are arranged on both sides with respect to the support portion 22 in the transport direction, are arranged in an inclined state, to thus form a mountain-shaped transport path with a flat top surface.

As illustrated in FIG. 1, the transport unit 14 includes a driving roller 25 and a driven roller 26. The driving roller 25 and the driven roller 26 transport the medium 99 by rotating in a nipping state nipping the medium 99. The driving roller 25 and the driven roller 26 are located between the upstream support portion 21 and the support portion 22 in the transport path. The driving roller 25 is configured to transport the medium 99 using a transport motor 77 (see FIG. 6) as the power source. The driving roller 25 and the driven roller 26 are composed of a pair of rollers configured to nip the medium 99. The driving roller 25 and the driven roller 26 are switched between a spaced apart state being spaced apart from each other and a nipping state nipping the medium 99 in between. The liquid discharge apparatus 11 is provided with an operation lever (not illustrated) that can be operated by the user to enable the driving roller 25 and the driven roller 26 to be switched between the spaced apart state and the nip state.

As illustrated in FIG. 1, the discharge unit 28 is disposed at a position facing the support portion 22. This allows the discharge unit 28 to discharge a liquid onto a portion of the medium 99, which is supported by the support portion 22. The liquid discharge apparatus 11 includes a gap adjustment mechanism 29 configured to adjust the gap between the discharge unit 28 and the support portion 22. The gap adjustment mechanism 29 moves the carriage 27 along the Z axis to adjust the gap between the discharge unit 28 and the support portion 22. This gap adjustment allows, regardless of the thickness of the medium 99, the gap between the discharge unit 28 and the medium 99 to be adjusted to a value suitable for printing.

As illustrated in FIG. 1, a suction mechanism 30 configured to suction the medium 99 to the support portion 22 with negative pressure is provided vertically below the support portion 22. The suction mechanism 30 is configured to apply negative pressure through a suction port 35 (see FIG. 2) that opens at a support surface 22A, which is a surface of the support portion 22 for supporting the medium 99, to suction the medium 99 to the support surface 22A.

Further, as illustrated in FIG. 1, the upstream support portion 21, the support portion 22, and the downstream support portion 23 include heaters 31, 32, and 33, respectively. Specifically, the preheater 31 configured to heat the upstream support portion 21 is provided on the back surface of the upstream support portion 21, the platen heater 32 configured to heat the support portion 22 is provided on the back surface of the support portion 22, and the afterheater 33 configured to heat the downstream support portion 23 is provided on the back surface of the downstream support portion 23. The preheater 31 is configured to preheat a portion of the medium 99 before performing printing with the heat from the upstream support portion 21 that is heated. The platen heater 32 is configured to heat a portion of the discharged region to which a liquid is discharged through nozzles 28A of the discharge unit 28 in the medium 99 with the heat from the support portion 22 that is heated. The afterheater 33 is configured to heat the portion, to which printing has been performed, of the medium 99 with the heat from the downstream support portion 23 that is heated. Note that each of the heaters 31 to 33 is composed of, for example, a planar heater.

For example, the temperature of the preheater 31 and the platen heater 32 is set to approximately 40° C., and the temperature of the afterheater 33 is set to approximately 50° C. that is higher than the temperature of the preheater 31 and the platen heater 32. The preheater 31 is configured to gradually increase the temperature of the medium 99 from the ordinary temperature toward the heating temperature of the platen heater 32 via the upstream support portion 21. The platen heater 32 is configured to heat the medium 99 via the support portion 22 to promptly dry the ink that landed on the medium 99. The afterheater 33 is configured to heat the medium 99 to a temperature that is higher than the heating temperature of the platen heater 32 via the downstream support portion 23, and to cause the liquid that landed on the medium 99 to be completely dried and fixed to the medium 99 before the medium 99 is wound to the reel mechanism 18.

As illustrated in FIG. 1, the liquid discharge apparatus 11 includes the drying device 40 configured to heat the medium 99 being transported in a state where a liquid adheres to the medium 99. The drying device 40 is located downstream of the position to which a liquid is discharged from the discharge unit 28 in the transport path. Accordingly, the drying device 40 heats and dries the medium 99 to which the liquid adheres.

The drying device 40 includes a heater tube 41. The heater tube 41 is located facing the downstream support portion 23. The heater tube 41 is configured to heat the printing surface of the medium 99 being supported and transported by the downstream support portion 23. The heater tube 41 is controlled to a predetermined heat-set temperature. In this case, as the heat-set temperature becomes higher, the output from the heater tube 41 becomes greater.

The drying device 40 includes a case 42 that accommodates the heater tube 41 and a circulation unit 43 configured to circulate gas inside the case 42. The case 42 opens at the side facing the downstream support portion 23. The circulation unit 43 includes a circulation path 44 through which gas flows, and an air blowing fan 45 located in the midstream of the circulation path 44. The circulation path 44 is a flow path coupling an intake port 46 that takes in gas and an air blowing port 47 that blows out gas. The circulation path 44 extends along a path surrounding the heater tube 41. The intake port 46 is located facing the downstream portion of the downstream support portion 23. The air blowing port 47 is located facing the upstream portion of the downstream support portion 23. The circulation unit 43 generates a first airflow AF1 by circulating the gas heated by the heater tube 41 at the paths inside the case 42 and along the upper surface of the downstream support portion 23. Specifically, a part of the gas heated near the surface of the medium 99 by the heater tube 41 is taken in through the intake port 46, and the intake gas is heated with the heat from the heater tube 41 in the course of passing through the circulation path 44. The heated gas is blown through the air blowing port 47 to the surface of the medium 99 again by the air blowing fan 45 to thus facilitate drying of the medium 99. The drying device 40 includes a reflection plate 48 that reflects the heat from the heater tube 41 toward the downstream support portion 23. The reflection plate 48 efficiently transmits heat from the heater tube 41 to the medium 99.

As illustrated in FIG. 1, the liquid discharge apparatus 11 includes a cutter device 50 configured to cut the medium 99 at a position downstream of the drying device 40 in the transport direction. In the liquid discharge apparatus 11, a selection can be made between a winding scheme in which the medium 99 after performing printing is wound as the roll body 102, and a cutting scheme in which the medium 99 after performing printing without being wound is cut to a predetermined size with the cutter device 50. The cutter device 50 includes, for example, a movable blade and a fixed blade, where the movable blade is moved along the X axis to cut the medium 99 to the predetermined size.

As illustrated in FIG. 1, a fan 51 configured to suction outside air into the housing 12 is provided in the housing 12. The fan 51 takes in the air filtered through a filter 52 through an intake port 12C provided on the housing 12 into the housing 12. A second airflow AF2 taken into the housing 12 passes through the periphery of the movement region of the discharge unit 28, and is mainly exhausted through an exhaust port 12B to the outside the housing 12. The interior of the housing 12 is ventilated with a clean air to remove foreign substances suspended in the air inside the housing 12.

The liquid discharge apparatus 11 also includes a humidity detection unit 53 configured to detect a humidity. In this example, the humidity detection unit 53 is provided inside the housing 12. The humidity detection unit 53 detects the humidity of the air taken in from the exterior of the housing 12 at a position downstream of the fan 51 in the air intake direction of the fan 51 inside the housing 12. This detection humidity corresponds to the humidity at the exterior of the housing 12, that is, a detection value of the humidity at the periphery of the liquid discharge apparatus 11.

The humidity detection unit 53 of this example includes a temperature/humidity sensor configured to detect a temperature in addition to a humidity. The temperature/humidity sensor detects the humidity and temperature of the outside air near the intake port of the outside air into the housing 12. The humidity detection unit 53 is located at the upper portion relative to the lower portion at which the discharge unit 28 is located inside the housing 12. Here, the lower portion inside the housing 12 tends to be relatively highly humid due to the influence of moisture vapor evaporated from the liquid adhering to the medium 99 immediately after performing printing is performed and the like. Further, at the lower portion inside the housing 12, the temperature of the outside air cannot be accurately detected due to the influence of the heat from the heating source such as the platen heater 32. Accordingly, the temperature/humidity sensor configuring the humidity detection unit 53 detects a humidity and temperature at the upper position inside the housing 12 that is not susceptible to this kind of moisture vapor and heating source. Note that the humidity detection unit 53 may be attached to the outer side face of the housing 12.

Further, as illustrated in FIG. 1, a humidifier 54 may be provided, inside the housing 12, as one example of a humidifying unit configured to humidify the interior of the housing 12. The humidifier 54 is driven by a control unit 70 when the humidity detected by the humidity detection unit 53 is not within a suitable humidity range. That is, when the humidity of the air at the exterior of the housing 12 (hereinafter, also referred to as "outside air") detected by the humidity detection unit 53 is less than a lower limit value A, the control unit 70 drives the humidifier 54 under certain conditions to increase the humidity at the periphery of the medium transport path inside the housing 12. This is because, when the humidity of the outside air is low, foreign substances such as dust and fluff are easily suspended in the air, to thus increase the content percentage of the foreign substances in the air taken into the housing 12. Accordingly, increasing the humidity inside the housing 12 causes the foreign substances suspended in the air to be precipitated, to thus suppress the occurrence of nozzle clogging due to the foreign substances. Note that a second humidity detection unit configured to detect the humidity in a humidified region in which the humidifier 54 performs humidification may be provided inside the housing 12, and the control unit 70 may drive and control the humidifier 54 based on the detection humidity of the second humidity detection unit, to thus adjust the humidity at the periphery of the discharge unit 28 to the target humidity. Further, the user may operate an operation panel 72 to select whether the humidifier 54 is driven.

The humidifier 54 includes a water reservoir section that retains water, and a humidification drive unit that converts the water in the water reservoir section into mist or moisture vapor. The humidification drive unit may be any type of a vapor type, an evaporated type, an ultrasonic type, an electrolysis type for performing humidification accompanying electrolysis of water using a solid polymeric electrolyte, or the like.

Further, as illustrated in FIG. 1, the liquid discharge apparatus 11 is installed with a dust catcher 55 as necessary on a feeding port 12A through which the medium 99 is fed into the housing 12. The dust catcher 55 is disposed upstream of the discharge unit 28 in the transport direction Y1, and comes in contact with a printed surface 99A at a portion before the liquid is discharged from the discharge unit 28. The dust catcher 55 comes in contact with the printed surface 99A in a state of substantially closing the feeding port 12A. The dust catcher 55 removes foreign substances such as dust and fluff adhering to the printed surface 99A, and suppresses the air in which the foreign substances are suspended from flowing into the housing 12 through the feeding port 12A. The dust catcher 55 is attached to a predetermined position near the feeding port 12A of the housing 12 with a magnet or screw. Note that the detailed configuration of the dust catcher 55 will be described later.

Further, a display unit 60 is provided on the outer face of the housing 12. The display unit 60 displays, in addition to various menu screens, input screens for printing condition information, and the like, messages or images prompting the user to perform various adjustments including adjustment of the humidity or temperature to make the environment at the periphery of the liquid discharge apparatus 11 or the inside the housing 12 suitable for printing, and messages or images prompting the user to perform various adjustments to suppress the occurrence of nozzle clogging or wrinkles, and the like. The liquid discharge apparatus 11 includes the control unit 70 inside the housing 12. The control unit 70 controls the transport unit 14, the feeding unit 15, the winding unit 17, the discharge unit 28, the carriage 27, the drying device 40, the display unit 60, and the like.

The liquid discharge apparatus 11 is used with selecting one of the winding scheme illustrated in FIG. 1, in which the medium 99 dried after performing printing is wound, or a non-winding scheme in which the medium 99 dried after performing printing is not wound. In the non-winding scheme, the medium 99 after performing printing is cut to a predetermined size with the cutter device 50 or is ejected in an elongated form without being cut.

Figure 2:
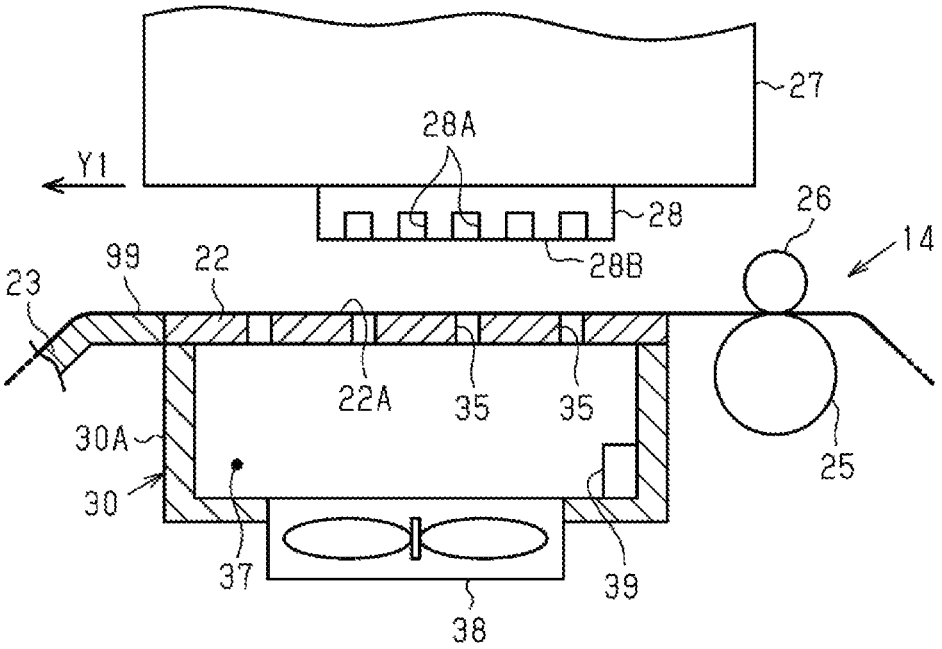
FIG. 2 is a side cross-sectional view schematically illustrating a suction mechanism.

Next, a detailed configuration of the suction mechanism 30 will be described with reference to FIG. 2. As illustrated in FIG. 2, the support portion 22 includes the suction port 35 that opens at the support surface 22A for supporting the medium 99. The liquid discharge apparatus 11 includes the suction mechanism 30 configured to generate negative pressure for causing a suction force to be exerted through the suction port 35 to suction the medium 99. To the lower portion of the support portion 22, a negative pressure chamber forming member 30A is assembled. Further, a negative pressure chamber 37 is formed surrounded by the support portion 22 and the negative pressure chamber forming member 30A. The suction port 35 communicates with the negative pressure chamber 37 through the support portion 22. A plurality of suction ports 35 that communicate with the negative pressure chamber 37 open at the support surface 22A. The suction mechanism 30 includes an exhaust fan 38 configured to exhaust the air inside the negative pressure chamber 37 to the outside. When the exhaust fan 38 is driven, the air inside the negative pressure chamber 37 is exhausted to the outside, and the pressure inside the negative pressure chamber 37 becomes negative. Thus, the medium 99 is suctioned to and supported by the support portion 22 by the negative pressure applied through the plurality of suction ports 35 that open at the support surface 22A.

In the liquid discharge apparatus 11, when there is a possibility that wrinkles 99S and floating occur in the medium 99 at the time when the discharge unit 28 discharges a liquid to print an image on the medium 99, the exhaust fan 38 is driven to cause the medium 99 to be suctioned to and supported by the support surface 22A. Further, a pressure sensor 39 configured to detect a pressure is provided inside the negative pressure chamber 37. The control unit 70, based on the detection pressure detected by the pressure sensor 39, controls the suction mechanism 30 such that the pressure inside the negative pressure chamber 37 reaches a predetermined set negative pressure value. In the first embodiment, a negative pressure is applied through the suction port 35 when the medium 99 is transported as well, and a suction force that causes the medium 99 to be suctioned to the support surface 22A is exerted on the medium 99 being transported. In this case, the excessive suction force during the transport process of the medium 99 increases the transport load of the medium 99, and also causes the wrinkles 99S to occur due to the transport load. Note that the control unit 70 may perform control that does not cause negative pressure to be applied through the suction port 35 while the medium 99 is transported.

Figure 3:
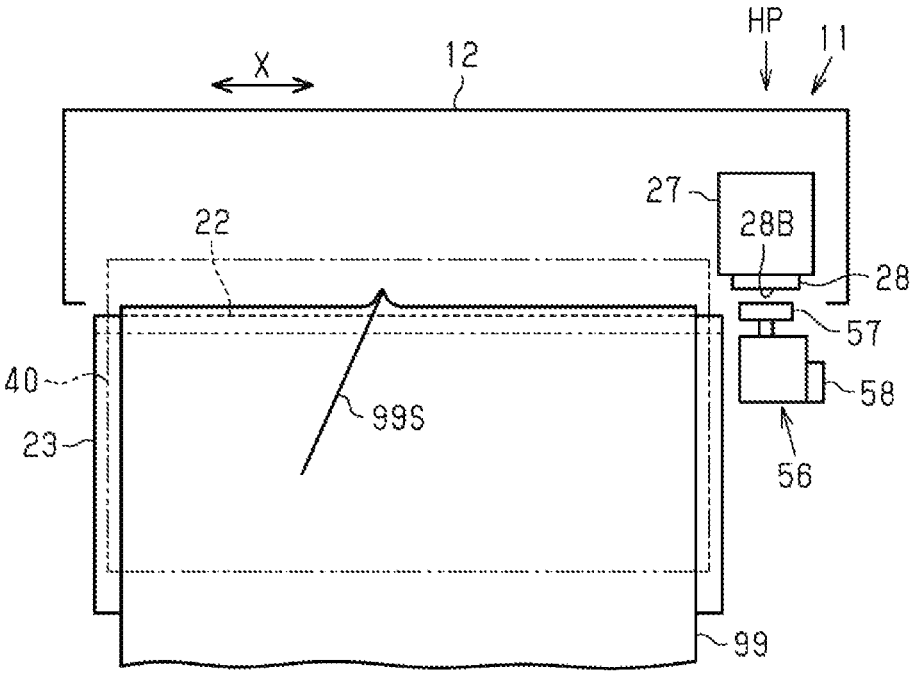
FIG. 3 is a front view schematically illustrating a liquid discharge apparatus.

As illustrated in FIG. 3, the carriage 27 reciprocatively moves along the X axis inside the housing 12. One end position of the movement range of the carriage 27 is a home position HP at which the carriage 27 stands by when printing is not performed by the discharge unit 28. A maintenance device 56 is disposed at the position facing the discharge unit 28 when the carriage 27 is at the home position HP. The maintenance device 56 performs cleaning of the nozzles 28A periodically as a discharge maintenance operation of the discharge unit 28 before or after performing printing based on a print job. The maintenance device 56 includes a cap 57, and a suction pump 58 configured to suction the air inside the cap 57. The cap 57 is provided movable along the Z axis, and can be separated from and in contact with a nozzle opening surface 28B at which the nozzles 28A open, of the discharge unit 28. When the cap 57 is in a capping state where the cap 57 is in contact with the nozzle opening surface 28B of the discharge unit 28, the suction pump 58 is driven to suction the air within the closed space surrounded by the nozzle opening surface 28B and the cap 57, to thus cause the interior of the cap 57 to be at a negative pressure. This allows the liquid to be forcibly suctioned and discharged through the nozzles 28A. This makes it possible to remove a defective liquid such as a thickening ink or the like inside the nozzles 28A and the air bubbles contained in the liquid. Note that the maintenance device 56, in addition to a suction scheme, may also be a pressure scheme in which a liquid is forcibly discharged through the nozzles 28A by pressurizing a liquid supply source (for example, an ink pack) that supplies the liquid to the discharge unit 28.

Figure 4:
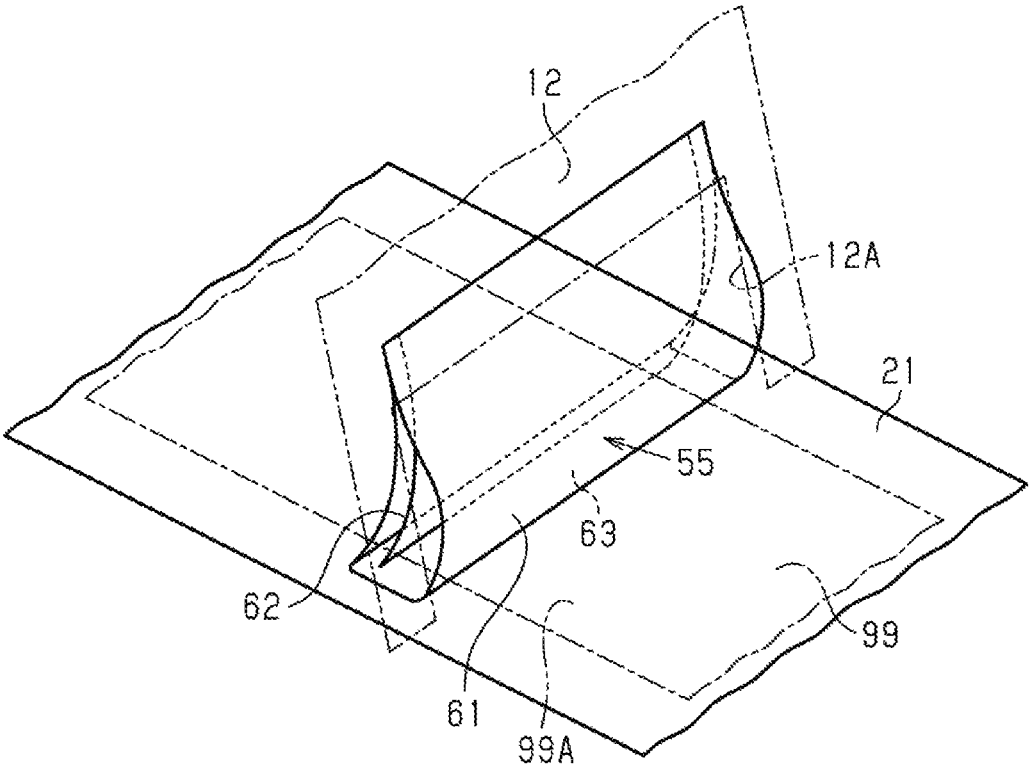
FIG. 4 is a perspective view schematically illustrating an installation state of a dust catcher.

Next, the dust catcher 55 will be described below with reference to FIG. 4. As illustrated in FIG. 4, the dust catcher 55 is installed to the feeding port 12A of the housing 12, in a state of coming in contact with the printed surface 99A of the medium 99 being transported over the upstream support portion 21 to cause the feeding port 12A to be closed. The dust catcher 55 is attached to a predetermined position vertically above the feeding port 12A of the housing 12 with a magnet or screw.

As illustrated in FIG. 4, the dust catcher 55 includes a removal member 61 having a loop shape and an elastic member 62 disposed at the inner side of the removal member 61. The removal member 61, which is formed of a collection of fibers, has flexibility. The removal member 61 is, for example, a nonwoven fabric, and may also be a felt or cloth.

The removal member 61, by deforming its loop shape with its own weight, makes it possible to adjust the contact area between a curved portion 63 at its lower portion and the printed surface 99A of the medium 99. The elastic member 62 has a function to retain the shape of the removal member 61 while allowing deformation within a predetermined range of the removal member 61. Accordingly, even when the removal member 61 is formed of a collection of fibers such as a nonwoven fabric, the curved portion 63 comes into contact with the printed surface 99A at a predetermined area and with a predetermined pressing force. The removal member 61, which is formed of a collection of fibers, collects the removed foreign substances inside the removal member 61 and suppresses scattering of the foreign substances. An increase of the area between the curved portion 63 of the dust catcher 55 and the printed surface 99A enhances the effect of suppressing intrusion of the foreign substances into the housing 12, however, the transport load of the medium 99 increases. The increase in the transport load of the medium 99 causes a reduction in the transport position accuracy of the medium 99, which leads to a defective, lateral displacement of the printing position. Accordingly, it is desirable that the dust catcher 55 be installed only when printing is performed in an environment where an intrusion of the foreign substances easily occurs. Note that the dust catcher 55 may be configured such that the control unit 70 drives a member for control to deform the removal member 61, to make it possible to adjust the contact area between the curved portion 63 and the printed surface 99A.

In this example, the liquid discharge apparatus 11 produces a printed material that printing is performed on the medium 99. The liquid discharge apparatus 11 may be configured as a textile printing machine of a sublimation-transfer type that the discharge unit 28 discharges a liquid to perform printing on a transfer paper being one example of the medium 99, and transfers the printed image from the transfer paper to a cloth. The liquid discharge apparatus 11, when being a textile printing machine, includes a pasting roller, in place of the tension bar 20 and the suction mechanism 30, as the function of pressing the medium 99 against the support surface 22A of the support portion 22. Driving the pasting roller to press the medium 99 against the support surface 22A has an effect of suppressing the occurrence of the wrinkles 99S in the medium 99, as in the suction mechanism 30.

Figure 5:
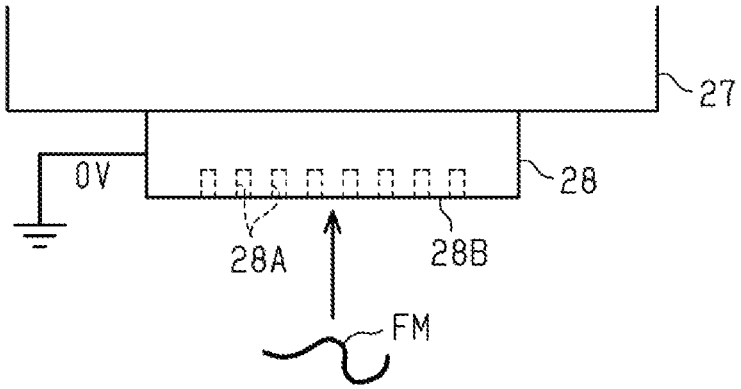
FIG. 5 is a view schematically illustrating how foreign substances adhere to a discharge unit.

Further, as illustrated in FIG. 5, the discharge unit 28 disposed inside the housing 12 is grounded via a metal frame or the like. Accordingly, the electrical potential of the nozzle opening surface 28B at which the nozzles 28A open in the discharge unit 28 is 0 V. Foreign substances FM suspended in the air such as dust and fibers are charged. Accordingly, the foreign substances FM suspended in the air inside the housing 12 adhere to the nozzle opening surface 28B of the discharge unit 28 by Coulomb's force. The foreign substances FM adhering to the nozzle opening surface 28B causes clogging of the nozzles 28A. The clogging of the nozzles 28A leads to a discharge failure that the discharge amount of the liquid is less than the expected amount or the liquid is failed to be discharged. The discharge failure will cause a printing failure.

When the humidity is at a first humidity, the foreign substances FM, such as dust and fibers, are easily suspended in the air compared to when the humidity is at the second humidity exceeding the first humidity. In the first embodiment, when the detection humidity detected by the humidity detection unit 53 is less than the lower limit value A, there is a concern in that nozzle clogging and the like occur due to the foreign substances FM. The control unit 70 then causes the display unit 60 to display a message prompting the user to perform temperature adjustment to raise the humidity. Here, the humidity tends to be high when the temperature is raised. Accordingly, the message prompts the user to raise the temperature. The message also prompts the user to conduct a countermeasure for reducing the foreign substances FM. Moreover, the message prompts the user to conduct a countermeasure for suppressing the occurrence of nozzle clogging due to the foreign substances FM. Note that the content of the message will be described later in detail.

As illustrated in FIG. 3, when the humidity outside the housing 12 is high, the occurrence of the wrinkles 99S in the medium 99 to which the discharged liquid adheres is facilitated. This is because of the following reasons. When the humidity outside the housing 12 is high, the moisture contained in the medium 99 increases. That is, when the humidity is high, the moisture content of the medium 99 before performing printing is high. When the moisture content of the medium 99 is high, the total moisture content of the medium 99 immediately after performing printing and to which the liquid discharged from the discharge unit 28 adheres is high. That is, the total moisture content of the medium 99 immediately after performing printing is higher when the humidity is at the second humidity exceeding the first humidity than when the humidity is at the first humidity. When the total moisture content of the medium 99 immediately after performing printing is high, the medium 99 to which the liquid adheres is hardly dried, and moreover, the amount of expansion of the medium 99 when the fibers of the medium 99 absorb the liquid to swell increases. and the occurrence of the wrinkles 99S is facilitated due to the increase in the amount of contraction when the medium 99, which has greatly swollen and expanded, contracts during the drying process.

As illustrated in FIG. 3, the wrinkles 99S occurred at the portion, to which printing has been performed, of the medium 99 may propagate upstream in the transport direction Y1 to the portion facing the discharge unit 28. In this case, when the wrinkles 99S are rubbed against the nozzle opening surface 28B of the discharge unit 28, the medium 99 is stained with an ink to cause a printing failure.

Then, the control unit 70, when the detection humidity detected by the humidity detection unit 53 exceeds an upper limit value B, causes the display unit 60 to display a message prompting the user to perform temperature adjustment to reduce humidity. Here, the humidity tends to be low when the temperature is lowered. Accordingly, in the first embodiment, a message is displayed to prompt the user to lower the temperature. Moreover, a message is displayed to prompt the user to conduct a countermeasure for suppressing the occurrence of the wrinkles 99S. Note that the content of the messages will be described later in detail.

Next, with reference to FIG. 6, an electrical configuration of the liquid discharge apparatus 11 will be described below. The liquid discharge apparatus 11 includes the control unit 70. The control unit 70 is electrically coupled with a communication unit 71, the operation panel 72, the humidity detection unit 53 configured to detect the humidity at the exterior of the housing 12, a temperature detector 73 configured to detect the temperature of the heating region heated by the drying device 40, and the pressure sensor 39 configured to detect the pressure of the negative pressure chamber 37 of the suction mechanism 30. The operation panel 72 includes the display unit 60 and an operation unit 74. When the display unit 60 is a touch panel, the operation unit 74 may be configured by an operation functional unit of a touch panel.

The control unit 70 is communicably coupled with a host apparatus 150 via the communication unit 71. The host apparatus 150 includes a display unit 160 and an operation unit 170 operated by the user. The host apparatus 150 includes a print driver (not illustrated) configured to generate data of a print job PJ when the user operates the operation unit 170 to provide a command for printing. The control unit 70 receives the data of the print job PJ from the host apparatus 150 via the communication unit 71. Note that the host apparatus 150 is configured by one of a personal computer, a Personal Digital Assistant (PDA), a tablet PC, a smart phone, a mobile phone, or the like, for example.

The humidity detection unit 53 includes a humidity sensor 75 configured to detect the relative humidity outside the housing 12, and a temperature sensor 76 configured to detect the temperature outside the housing 12. The humidity detection unit 53 of this example is composed of a temperature/humidity sensor that the humidity sensor 75 and the temperature sensor 76 are built into a single sensor unit. The humidity detection unit 53 calculates an absolute humidity AH in accordance with a predetermined calculation equation using information about a relative humidity RH (%) detected by the humidity sensor 75 and a temperature T (° C.) detected by the temperature sensor 76. The absolute humidity AH is calculated with $AH=217\times e(T)/(T+273.15)\times RH/100$, where e(T) is saturation vapor pressure and is calculated using Tetens equation given as $e=6.11\times 10\hat{}(7.5T/(T+237.3))$. Note that the humidity detection unit 53 may be configured to include a part (humidity calculation unit) of the control unit 70 configured to calculate the absolute humidity AH from each of the values of the humidity and temperature detected by the humidity sensor 75 and the temperature sensor 76, respectively. In addition, the humidity detection unit 53 may be configured to include the humidity sensor 75 and the temperature sensor 76 separately in place of the temperature/humidity sensor. Alternatively, one or both of the humidity sensor 75 and the temperature sensor 76 may be provided at the external of the housing 12.

The control unit 70 is input with, via a non-illustrated input interface, an operation signal generated when the operation unit 74 is operated, a humidity detection value detected by the humidity sensor 75, a temperature detection value detected by the temperature sensor 76, an absolute humidity detection value detected by the humidity detection unit 53 based on information about humidity and temperature, a pressure detection signal from the pressure sensor 39, and a temperature detection signal from the temperature detector 73.

The control unit 70 is also electrically coupled with the feeding motor 16, the transport motor 77, the winding motor 19, the discharge unit 28, a carriage motor 78, the suction mechanism 30, the preheater 31, the platen heater 32, the afterheater 33, the gap adjustment mechanism 29, the humidifier 54, and the maintenance device 56. The control unit 70 is also electrically coupled with the heater tube 41 and the air blowing fan 45 configuring the drying device 40. The transport motor 77 is the drive source for the driving roller 25 configuring the transport unit 14. The carriage motor 78 is the drive source for the carriage 27. Note that the liquid discharge apparatus 11, when being a line printer, is electrically configured such that the carriage motor 78 is removed from the configuration in FIG. 6.

The print job PJ received by the control unit 70 from the host apparatus 150 contains various commands necessary for the print control, the printing condition information designated by the user, and the print image data. The control unit 70 controls various motors 16, 19, and 77 and the like based on the printing condition information contained in the print job PJ, and controls the discharge unit 28 based on the print image data to discharge a liquid through the nozzles 28A, to thus draw an image with dots formed by droplets that land on the medium 99. Note that hereinafter, the term "print job PJ" is also referred to as "job PJ" in a simple manner.

The control unit 70 drives the gap adjustment mechanism 29 in accordance with a medium type acquired from the printing condition information to displace the carriage 27 along the Z axis, to thus adjust the gap between the discharge unit 28 and the medium 99 to a value corresponding to the medium type. The control unit 70, when the "high definition printing" of high print resolution is required in the job PJ, performs adjustment of the gap between the discharge unit 28 and the medium 99 to a first gap in order to enhance the dot position accuracy of the discharge unit 28. On the other hand, the control unit 70, when the "regular printing" of low print resolution is required in the job PJ, printing speed is prioritized over the dot position accuracy of the discharge unit 28, and thus the gap is adjusted to a second gap greater than the first gap. In this way, even with the same medium type, the gap is adjusted in accordance with the print resolution that is required. Note that the gap adjustment mechanism 29 employs a mechanically driven scheme in which the control unit 70 causes the carriage 27 to reciprocatively move in a predetermined interval within the movement region, and causes the carriage 27 to operate a drive lever (not illustrated) to mechanically drive the gap adjustment mechanism 29, or an electrical operation scheme in which a dedicated motor is driven to adjust the gap.

The control unit 70 measures the elapsed time since the previous cleaning time with a non-illustrated timer, and provides, when the elapsed time has elapsed for a predetermined period of time and reaches the edge period of the job PJ, that is, the cleaning time set before or after the job, a command for performing a discharge maintenance operation to the maintenance device 56 in a state where the carriage 27 is disposed at the home position HP. The maintenance device 56 causes, based on the command from the control unit 70, the cap 57 to be in a capping state where the cap 57 is brought into contact with the nozzle opening surface 28B of the discharge unit 28, and causes a liquid to be forcibly discharged through the nozzles 28A, to thus perform cleaning of the nozzles 28A.

Figure 6:
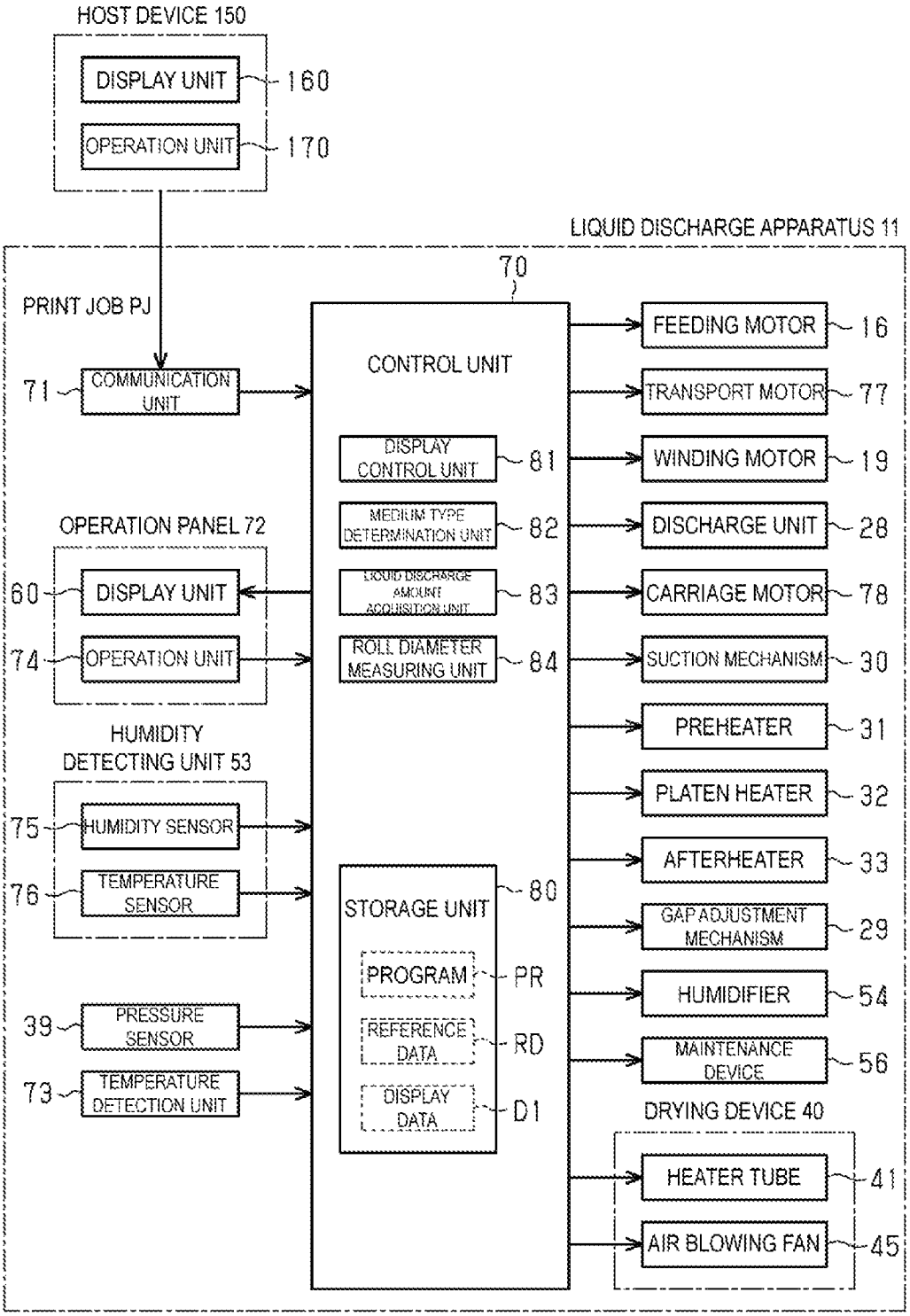
FIG. 6 is a block diagram illustrating an electrical configuration of a liquid discharge apparatus.

The control unit 70 illustrated in FIG. 6 includes a CPU, an Application Specific Integrated Circuit (ASIC), and a storage unit 80 (memory) composed of a RAM, a nonvolatile memory, and the like. The CPU executes a control program stored in the storage unit 80 to administrate various types of control including print control. The storage unit 80 stores a program PR of the control sequence represented in the flowchart in FIG. 10 contained in the control program. The CPU of the control unit 70 executes the program PR after the liquid discharge apparatus 11 is powered on. The storage unit 80 also stores reference data RD and display data D1.

The reference data RD are data referred to by the control unit 70 when the control unit 70 determines, based on an absolute humidity detected by the humidity detection unit 53, whether the absolute humidity is in a printing environment appropriate region HA suitable for printing. The display data D1 are data of the display screen to be displayed on the display unit 60. The control unit 70 includes a display control unit 81, a medium type determination unit 82, a liquid discharge amount acquisition unit 83, and a roll diameter measuring unit 84 as function units that function by executing the program PR.

The control unit 70 refers to the reference data RD based on the absolute humidity detected by the humidity detection unit 53, and determines whether the absolute humidity falls within the printing environment appropriate region HA. As a result, the control unit 70, when the absolute humidity deviates from the printing environment appropriate region HA, provides a command for causing the display units 60 and 160 to display an indication for the user about the determination result and an indication prompting the user to conduct a countermeasure that can suppress the printing failure to the display control unit 81. The display control unit 81 selects one set of display screen data corresponding to the determination results of the control unit 70 from the display data D1 stored in the storage unit 80, and causes the display unit 60 to display the display screen. The display control unit 81 also provides a command for displaying the display screen corresponding to the determination results to the host apparatus 150. The host apparatus 150 displays the display screen instructed to be displayed by the display control unit 81 on the display unit 160. The display control unit 81 and the host apparatus 150 cause the display units 60 and 160 to display display screens 91 illustrated in FIGS. 11 to 16, for example.

The medium type determination unit 82 determines a medium type being a type of the medium. The medium type determination unit 82 determines the medium type based on medium type information in the printing condition information contained in the job PJ. Examples of the medium type include plain paper, glossy paper, matte paper, and the like. In addition, the information about the medium type contains information about basis weight regarding the medium thickness. Accordingly, the medium type determination unit 82 distinguishes thin paper, cardboard, or the like that are classified by the medium thickness using the information about the basis weight, without the medium type being limited to plain paper, glossy paper, and the like, to determine the medium type. The medium type determination unit 82 determines whether the medium 99 is of a specific medium type.

The liquid discharge amount acquisition unit 83 acquires an average discharge amount, which is the discharge amount per medium area of the liquid discharged from the discharge unit 28. The liquid discharge amount acquisition unit 83 calculates the total amount (g) of the liquid to be discharged for one image based on the image data contained in the job PJ, and divides the total amount of the liquid by the medium area (mˆ2) on which the image is to be printed, to thus acquire the average discharge amount (g/mˆ2). The value of the average discharge amount is multiplied with "100" to obtain the average discharge amount (%). For example, a solid printing, which ink adheres to the entire image region and with no white space, has the average discharge amount of 100%. Note that the symbol "ˆ" indicates power. The "mˆ2" indicates square meters. In addition, the "mˆ3" that will be described later indicates cubic meters.

The roll diameter measuring unit 84 measures the roll diameter of the roll body 102 loaded on the winding unit 17. The roll diameter measuring unit 84 acquires the medium type and the basis weight from the printing condition information of the medium 99. The user also operates the operation panel 72 or the operation unit 170 of the host apparatus 150 to input the initial roll size when the roll body 102 is loaded on the winding unit 17. The roll diameter measuring unit 84 counts the number of pulse edges of the detection pulse input from the rotary encoder configured to detect the rotation of the winding motor to acquire the winding rotation amount of the roll body 102. The roll diameter measuring unit 84 measures the current roll diameter using the initial roll diameter, the winding rotation amount, and the medium thickness. Here, even when the winding force of the winding unit 17 is constant, when the roll diameter of the roll body 102 becomes greater, the front tension exerted on the medium 99 become relatively greater. Note that the roll diameter measuring unit 84 may be configured to include a sensor configured to measure the roll diameter of the roll body 102 loaded on the winding unit 17, to measure the roll diameter based on the detection value of the sensor.

Note that the control unit 70, upon receiving a command for initiating reel measurement in a state where the medium 99 is set to the transport unit 14 after powered on, executes the reel measurement. In the reel measurement, the winding load is measured when the winding unit 17 is caused to wind the medium 99 under a state where no tension is being exerted on the medium 99. The control unit 70 then adds the torque corresponding value of the target tension to be exerted on the medium 99 corresponding to the medium type and the medium width to the torque corresponding value of the winding load obtained from the measurement result of the reel measurement, to obtain a target rotational torque over the control of the winding motor 19. The control unit 70 controls the winding motor 19 with the obtained target rotational torque to thus apply a front tension, which is a tension exerted on the region between the transport unit 14 and the roll body 102 in the medium 99 being wound.

The control unit 70 also controls the amount of transport by which the transport unit 14 transports the medium 99 and the feed amount by which the feeding unit 15 feeds out the medium 99 from the roll body 101, to apply a back tension, which is a tension exerted on the region between the roll body 101 and the transport unit 14 in the medium 99. Specifically, the control unit 70 transports the medium 99 while controlling the feed amount to be slightly less than the transport amount to cause a slight slippage between the rollers, to thus apply a back tension to the medium 99.

In the liquid discharge apparatus 11 of this example, the liquid discharged from the discharge unit 28 is a water-based ink, for example. Accordingly, in the heating and drying process in which the medium 99 to which the discharged liquid adheres is heated for drying, a moisture vapor evaporated from water in the liquid is generated. In addition, the medium 99 is, for example, a paper, and the medium 99 to which the discharged liquid adheres expands when the paper fibers absorb the liquid to swell, and then contracts when the moisture is evaporated and the medium 99 is dried in the heating and drying process. The amount of expansion and contraction of the medium 99 at this time varies depending on the medium type and the average discharge amount (%). Note that the solvent or dispersion medium contained in the liquid may be a water-soluble organic solvent. The solvent or dispersion medium may further be a water-insoluble organic solvent.

Figure 7:
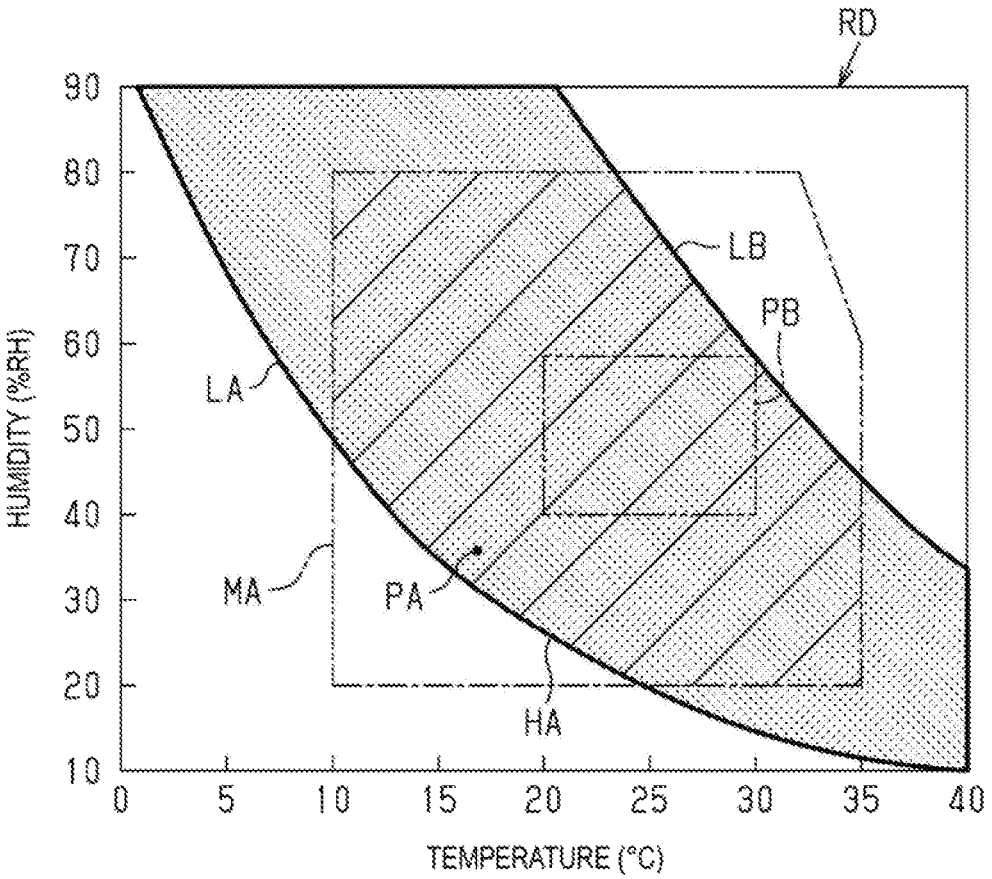
FIG. 7 is a graph illustrating a content of reference data and illustrating a printing environment appropriate region related to absolute humidity.

FIG. 7 is an explanatory graph for the reference data RD referred to when the control unit 70 determines whether the absolute humidity falls within the printing environment appropriate region HA, which is a humidity range suitable for printing. The reference data RD is set based on the result of the experimental data indicated in this graph.

In the graph illustrated in FIG. 7, the horizontal axis is temperature (° C.), and the vertical axis is relative humidity (% RH). A line LA in the graph is the lower limit line indicating the lower limit value A (g/cm^3) of the printing environment appropriate region HA, and A line LB is the upper limit line indicating the upper limit value B (g/cm^3) of the printing environment appropriate region HA.

where the absolute humidity represents the density of moisture vapor contained in the atmosphere. In contrast, the amount of moisture (saturated moisture vapor content) that an air can contain in the form of moisture vapor is determined to a constant value by temperature under atmospheric pressure. With this limit value being 100, a numerical value represented by some percentage % of the amount of moisture in the actual air per the maximum limit, is the relative humidity (% RH).

The region below the line LA where the absolute humidity AH is less than the lower limit value A (g/m^3) is a first inappropriate region in which the ratio of the foreign substances FM such as dust and fluff being suspended in the atmosphere is high, facilitating the occurrence of the printing failure caused by nozzle clogging due to the adhesion of the foreign substances FM to the discharge unit 28. Further, the region above the line LB where the absolute humidity AH exceeds the upper limit value B (g/m^3) of the printing environment appropriate region HA is a second inappropriate region in which the wrinkles 99S easily occur due to high humidity. In the second inappropriate region, the medium 99 absorbs the moisture in the atmosphere to increase the moisture content in the medium 99, increasing the total moisture content in the medium 99 to which the liquid has adhered. Then, the amount of expansion and contraction when the medium 99 swells and contracts during the drying process increases. This facilitates the occurrence of the wrinkles 99S. That is, the line LB is a boundary line that indicates the threshold value at which the occurrence of the wrinkles 99S in the medium 99 is facilitated when the absolute humidity exceeds the value of the line LB.

The upper limit value B is a value greater than the lower limit value A (B>A). The lower limit value A is a value within the range from 3 to 7 (g/cm^3), as one example. Further, the upper limit value B is a value within the range from 13 to 20 (g/cm^3), as one example. The lower limit value A and the upper limit value B vary depending on the models of the printer because the printing conditions and the heating/drying conditions vary for each of the models. In addition, the lower limit value A and the upper limit value B vary depending on the types of the medium 99 even with the same one model. Note that in the first embodiment, the lower limit value A corresponds to one example of the first predetermined value, and the upper limit value B corresponds to one example of the second predetermined value.

In the graph of FIG. 7, the range in which the absolute humidity is not less than the lower limit value A and not greater than the upper limit value B (g/m^3) is set as the printing environment appropriate region HA. Thus, as for the liquid discharge apparatus 11, the printing environment appropriate region HA, which is a range surrounded by the thick line in the graph illustrated in FIG. 7, is the recommended range regarding the humidity. Further, in the graph of FIG. 7, the region PB surrounded by the two-dot chain line is the recommended range of the comparative example. Traditionally, the user used to adjust the temperature and humidity within a room where the liquid discharge apparatus 11 is installed to fall within the recommended range of the comparative example. For example, the indoor temperature is adjusted with an air conditioner, and the indoor humidity is adjusted using a humidifier.

In addition, the liquid discharge apparatus 11 has a suitable operating environment regarding the absolute humidity. For example, in view of the operating performance of the liquid discharge apparatus 11 and the durability of the components, an operating environment appropriate region MA is set as the range of the absolute humidity suitable for the operation. In the graph illustrated in FIG. 7, the operating environment appropriate region MA is the square frame region indicated by the dot-and-dash line. Accordingly, in the liquid discharge apparatus 11, a printing appropriate region PA, which is a region where the printing environment appropriate region HA overlaps with the operating environment appropriate region MA, is actually the recommended region. Note that the operating environment appropriate region MA may be a region encompassing the printing environment appropriate region HA, or may be omitted as long as the operating performance, the durability of the components, and the like is guaranteed in the normal range of use.

The range of the absolute humidity AH defining the printing environment appropriate region HA illustrated in FIG. 7 is the reference data RD stored in the storage unit 80. The control unit 70 refers to the reference data RD to determine whether the absolute humidity AH detected by the humidity detection unit 53 falls within the printing environment appropriate region HA illustrated in FIG. 7. That is, the control unit 70 determines whether the absolute humidity AH detected by the humidity detection unit 53 falls within the range of not less than the lower limit value A or not greater than the upper limit value B. Note that a method for determining, based on the relative humidity RH detected by the humidity sensor 75 (RH %) and the temperature T (° C.) detected by the temperature sensor 76, whether the temperature T and humidity RH at present fall within the printing environment appropriate region HA with reference to the reference data RD composed of the two-dimensional map illustrated in FIG. 7 may be employed.

Figure 10:
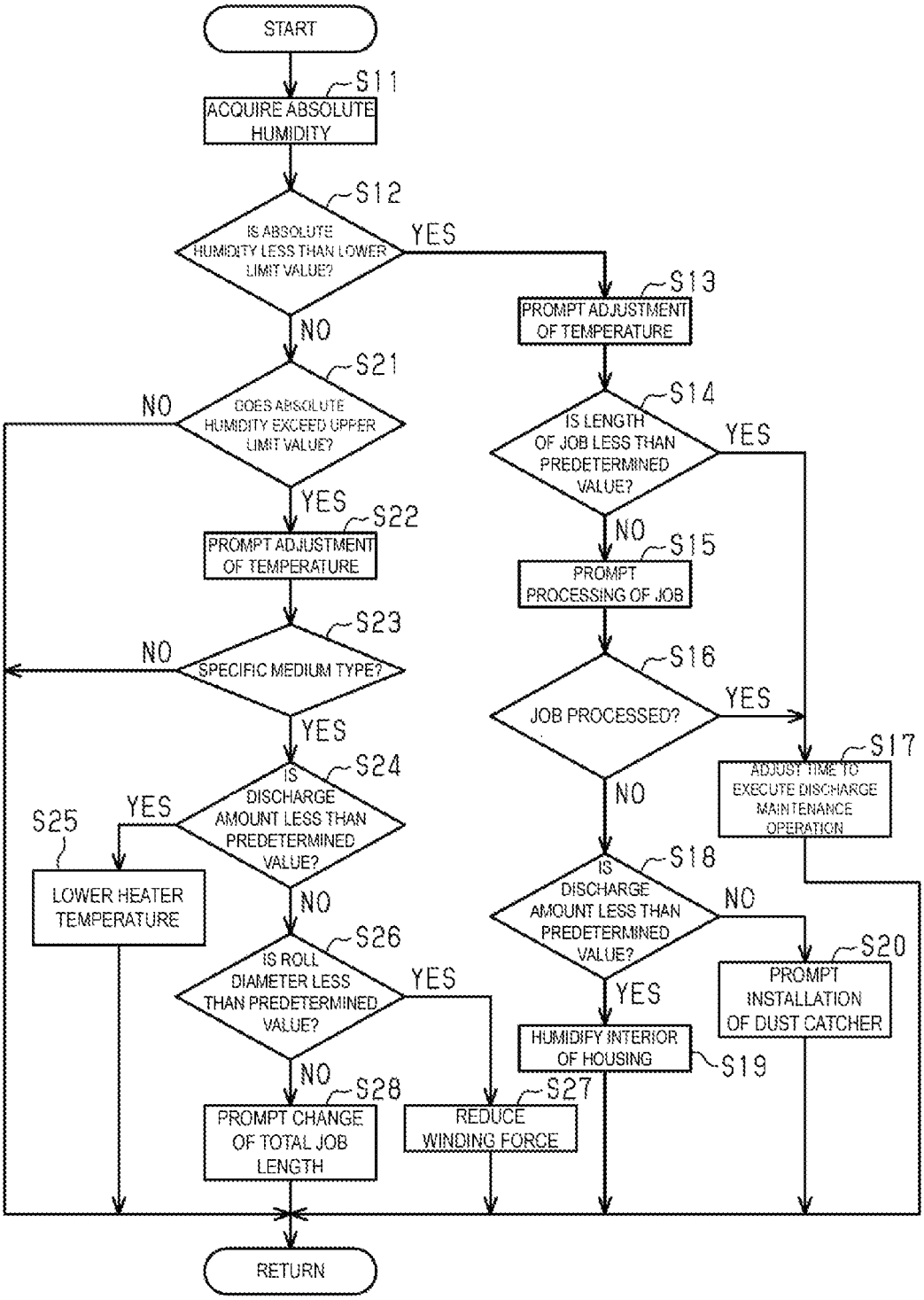
FIG. 10 is a flowchart illustrating a control sequence of performing control based on environmental information during printing.
Figure 11:
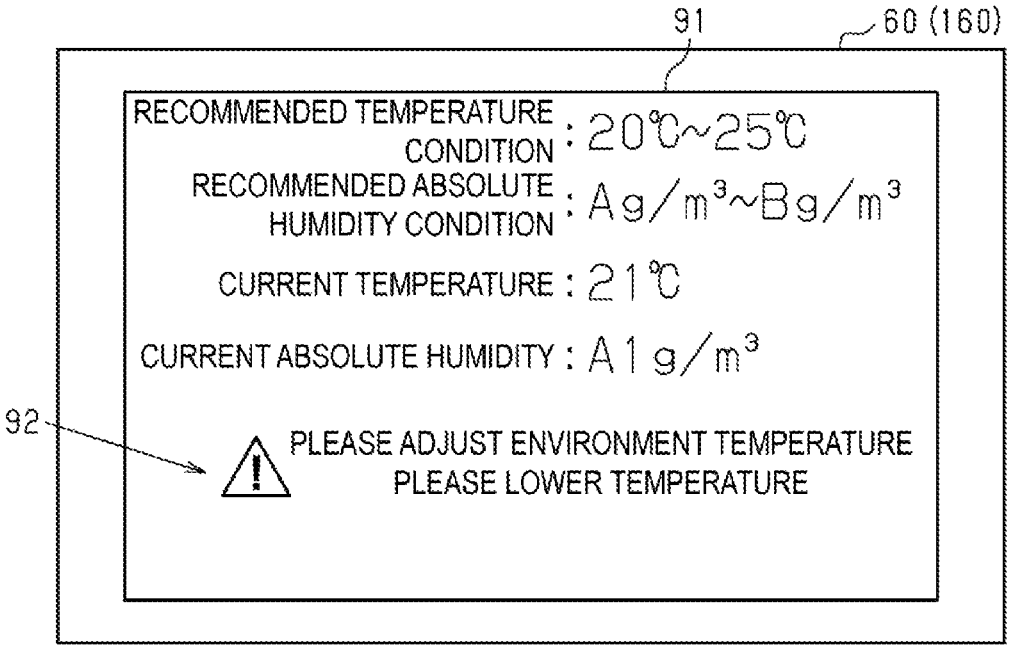
FIG. 11 is a diagram illustrating a display screen prompting adjustment of a temperature when a humidity is less than a lower limit.

The control unit 70, when the current absolute humidity deviates from the printing environment appropriate region HA, causes the display unit 60 to display the display screen 91 prompting the user to manually adjust the temperature or humidity, to cause the absolute humidity AH to fall within the printing environment appropriate region HA. For example, the display screen 91 includes a recommended temperature range, a recommended absolute humidity range, a current temperature, a current absolute humidity, and a message 92 prompting the user to manually adjust the content of the message 92 (FIG. 10, FIG. 11, and the like).

Note that the control unit 70 calculates the absolute humidity AH using the relative humidity RH detected by the humidity sensor 75 and the temperature T detected by the temperature sensor 76 by the following method. In addition, the control unit 70 separately determines whether the current absolute humidity falls within the operating environment appropriate region MA. Then, the control unit 70 may determine a content prompting the user to manually adjust the content to cause the absolute humidity AH to fall within the printing appropriate region PA indicated by the hatching in FIG. 7.

In the liquid discharge apparatus 11, one set of the job PJ is a unit of command data that can instruct, at one time, the liquid discharge apparatus 11 to print one image or to sequentially print a plurality of images. The user can perform processing called nesting that connects a plurality of images to lengthen the one set of the job PJ, to thus eliminate a wasted white space between images. When a cleaning is performed in the middle of an image when performing printing, color unevenness occurs at the middle of the image. Accordingly, a discharge maintenance operation for cleaning the nozzles 28A before the start or after the termination of the printing operation based on the one set of the job PJ is performed. When the one set of the job PJ is lengthened, the length that can be printed without causing white spaces can be elongated, to thus enhance the productivity of the printed material. However, when the length of the job PJ is lengthened, there is a concern in that the cleaning interval is elongated to increase the occurrence frequency of clogging of the nozzles 28A.

Accordingly, the liquid discharge apparatus 11 guarantees the length of the job PJ that does not cause the printing failure caused by nozzle clogging or the like to occur without performing cleaning. The user sets the length of the job PJ within the range not greater than an upper limit L1 (*m*) of a guaranteed job length MLBD that is the length of the job PJ that is guaranteed. The user performs processing of connecting a plurality of images within the range not greater than the upper limit of the guaranteed job length MLBD to lengthen the one set of the job PJ to reduce the white space between jobs. In addition, the guaranteed job length MLBD is a value guaranteed when the absolute humidity AH falls within the printing environment appropriate region HA, where the absolute humidity AH is less than the lower limit value A, then the guaranteed job length MLBD is no longer guaranteed. That is, the guaranteed job length MLBD is shortened. In this case, the user processes the length of the job PJ to a value less than the upper limit of the guaranteed job length MLBD that is guaranteed under the humidity at that time after the guaranteed job length MLBD is changed. Even when the absolute humidity AH is less than the lower limit value A, the length of the job PJ is set to be short to less than a predetermined value shorter than the upper limit L1 (*m*) of the guaranteed job length MLBD, causing the cleaning interval to be shortened. This can contribute to the suppression of the nozzle clogging in the discharge unit 28. This is effective as a countermeasure to suppress nozzle clogging, although reducing the productivity.

Figure 8:
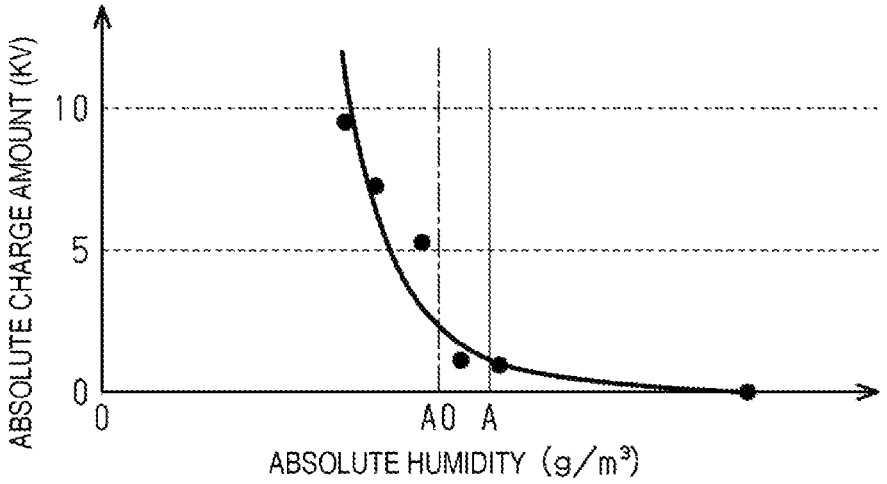
FIG. 8 is a graph illustrating a relationship between absolute humidity and chargeability of foreign substances.

FIG. 8 illustrates an evaluation test result that clarifies the lower limit value A of the printing environment appropriate region HA illustrated in FIG. 7. In the graph illustrated in FIG. 8, the horizontal axis is absolute humidity (g/m^3), and the vertical axis is absolute charge amount (KV). Samples of materials assuming various foreign substances are prepared, and evaluation tests are conducted to evaluate the easiness of charging for each of the samples. The sample is, for example, a rectangular parallelepiped with a predetermined size of 1 to several cm cube. The sample is charged by applying a predetermined voltage (for example, 20 KV) within the range from 10 to 30 KV. The sample after being charged is left until basically completely discharged under an atmosphere of absolute humidity. The absolute charge amount (KV) is measured, by placing the probe against the sample, a plurality of times with respect to the time elapsed. The measurement results in case when the sample is a cotton match the characteristics of the typical foreign substances. FIG. 8 illustrates the absolute charge amount with respect to the absolute humidity at a predetermined time when the measurement is conducted in case when the sample is a cotton. The predetermined time is a time when a predetermined period of time (for example, 20 seconds) has elapsed within the range from 10 to 30 seconds, for example. In the range from A0 (g/cm^3) or higher of the absolute humidity, the absolute charge amount is significantly reduced. That is, it can be recognized that the sample is hardly charged in the range from A0 (g/cm^3) or higher of the absolute humidity. In this example, an absolute humidity A (g/cm^3) that the absolute humidity is A0 (g/cm^3) or higher and the guaranteed job length MLBD can be set to L1 (*m*) or greater is the lower limit value of the printing environment appropriate region HA.

Note that the upper limit value B (g/cm^3) is determined by conducting a printing evaluation test on the presence or absence of wrinkles that occur in the medium 99 under various absolute humidity conditions. In the printing evaluation test, under the various absolute humidity conditions, printing is performed on the medium 99 under a predetermined printing condition under which the wrinkles 99S easily occur. The presence or absence of the wrinkles 99S is visually observed for the medium 99 being printed, and the absolute humidity under which the wrinkles 99S do not occur is added with a predetermined margin and is set to the upper limit value B (g/cm^3) of the printing environment appropriate region HA.

The display control unit 81 illustrated in FIG. 6 displays an indication prompting the user to conduct a countermeasure in accordance with the determination results of the control unit 70. Hereinafter, a determination condition and a content displayed to prompt the user to perform the content when the determination condition is established will be described.

The display control unit 81, when the humidity detection unit 53 detects a humidity less than the lower limit value A, displays an indication prompting adjustment of the temperature or humidity. In the first embodiment, the lower limit value A corresponds to one example of the first predetermined value. The display control unit 81, when the humidity detection unit 53 detects a humidity exceeding the upper limit value B, also displays an indication prompting adjustment of the temperature or humidity. In the first embodiment, the upper limit value B corresponds to one example of the second predetermined value. In the first embodiment, the display control unit 81 displays an indication prompting adjustment of the temperature of the temperature and humidity. The temperature is adjusted to indirectly adjust the humidity. This is because the temperature can be adjusted by changing the set temperature of the air conditioner, and can be easily coped with compared to the adjustment of the humidity. This is also because, compared to the case where the user manages both the temperature and relative humidity, it is sufficient to perform temperature adjustment when an indication prompting adjustment of the temperature is displayed, which reduces the burden on the user.

The display control unit 81, when the length of the job PJ to be executed by the discharge unit 28 and the transport unit 14 is not less than the predetermined value JL3 in case when the humidity detection unit 53 detects a humidity less than the lower limit value A, displays an indication prompting change of the length of the job PJ to less than a predetermined value JL3. Here, the predetermined value JL3 is a value corresponding to a value corresponding to the print length or the value subtracted with a predetermined margin, where the print length can be printed during the execution interval time of the discharge maintenance operation applied when the humidity detection unit 53 detects the absolute humidity AH within a suitable humidity range (not less than A and less than B). The user viewing the indication then operates the operation unit 74 or 170, and provides a command to the control unit 70 to change the length of the job PJ to less than the predetermined value JL3. The control unit 70, when the length of the job PJ is less than the predetermined value JL3, changes the time to execute the discharge maintenance operation of the discharge unit 28 to before the start or after the termination of the job PJ. Note that in the first embodiment, the predetermined value JL3 corresponds to one example of the third predetermined value.

The display control unit 81, when the humidity detection unit 53 detects a humidity exceeding the upper limit value B and when the diameter of the medium in a rolled form is not less than a predetermined value WD4 (*cm*), also displays an indication prompting change of the length of the job PJ to be executed by the discharge unit 28 and the transport unit 14. Here, the predetermined value WD4 is a value that facilitates the occurrence of the lateral displacement of the medium 99 when the roll diameter becomes not less than the value. Note that in the first embodiment, the predetermined value WD4 corresponds to one example of the fourth predetermined value.

The display control unit 81, when the humidity detection unit 53 detects a humidity exceeding the upper limit value B and when the diameter of the medium in a rolled form is not less than the predetermined value WD4, displays an indication prompting setting the total job length, which is the lengths of all of the jobs when the display control unit 81 causes the discharge unit 28 and the transport unit 14 to execute the job and causes the winding unit 17 to wind the medium 99 into a rolled form, to be less than a predetermined value JL5. Here, the predetermined value JL5 is a value shorter than the maximum total job length allowed when the humidity detection unit 53 detects a humidity not greater than the upper limit value B. Note that in the first embodiment, the predetermined value JL5 corresponds to one example of the fifth predetermined value. The display control unit 81, based on the humidity detected by the humidity detection unit 53, also displays the time to execute the discharge maintenance operation of the discharge unit 28.

Figure 9:
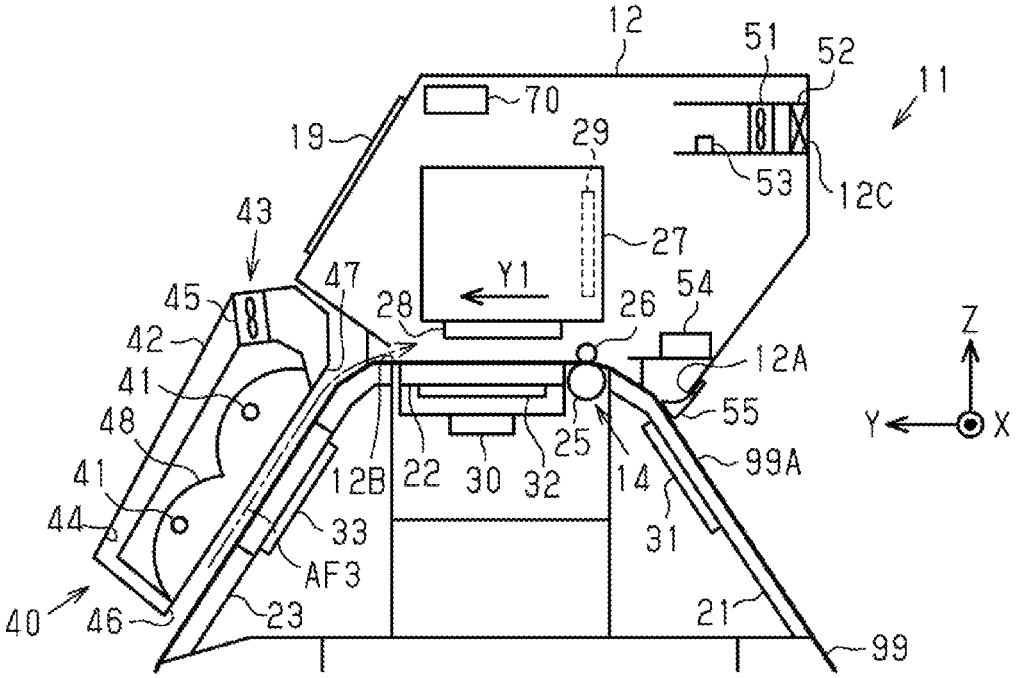
FIG. 9 is a partial side cross-sectional view schematically illustrating a liquid discharge apparatus.

Next, with reference to FIG. 9, a humidification mode for humidifying the interior of the housing 12 using the drying device 40 will be described below. As illustrated in FIG. 9, when the heater tube 41 performs heating in a state where the control unit 70 stops the air blowing fan 45 in the drying device 40, a third airflow AF3 that the heated air between the case 42 and the downstream support portion 23 flows upward by a chimney effect toward the housing 12, is generated. The third airflow AF3 is a highly humid airflow including moisture vapor evaporated from the liquid adhering to the medium 99. Accordingly, the third airflow AF3 flown upward flows into the housing 12 through the exhaust port 12B. The liquid discharge apparatus 11 of the first embodiment includes the fan 51 that causes the second airflow AF2 to be exhausted through the exhaust port 12B for the purpose of ventilating the interior of the housing 12 with a clean air. Accordingly, in order not to prevent the third airflow AF3 flown upward from flowing into the housing 12 through the exhaust port 12B, the control unit 70 stops driving the fan 51 inside the housing 12 or drives the fan 51 with less blowing power. This allows the humidity inside the housing 12 to rise. The control unit 70, by driving and controlling the drying device 40 in this way, allows the liquid discharge apparatus 11 to be operated in the humidification mode. In this example, the drying device 40 in the humidification mode configures one example of the humidifying unit. The user can operate the operation panel 72 to instruct the liquid discharge apparatus 11 to perform operation in the humidification mode. That is, the user operates the operation panel 72 to cause the drying device 40 to be driven as a humidifying unit.

Next, the action of the liquid discharge apparatus 11 will be described below. The foreign substances FM adhering to the medium 99 and the foreign substances FM suspended in the air intrude into the housing 12 through the feeding port 12A. The foreign substances FM intruded into the housing 12 are positively or negatively charged. The discharge unit 28, which is at an electrical potential of 0 V, facilitates the foreign substances FM that is charged to adhere to the nozzle opening surface 28B. The foreign substances FM adhering to the nozzle opening surface 28B induces nozzle clogging. Note that the nozzle clogging refers to a phenomenon that droplets cannot be normally discharged, and includes, in addition to the phenomenon that a liquid cannot be discharged, a phenomenon that the amount of discharging the liquid is less than the amount at normal time.

Incidentally, the amount of the foreign substances FM suspended in the air varies depending on the absolute humidity. When the absolute humidity is low, the foreign substances FM are easily suspended in the air. Thus, the amount of the foreign substances suspended in the air increases. On the other hand, when the absolute humidity is high, the foreign substances FM contain moisture and are less likely to be suspended in the air. Thus, the amount of the foreign substances suspended in the air decreases. When the absolute humidity is low as such, the amount of foreign substances FM suspended in the air inside the housing 12 increases, facilitating the occurrence of nozzle clogging, which is unfavorable as a printing environment. Accordingly, in the first embodiment, printing in an environment where the absolute humidity is not less than the lower limit value A is recommended. Note that there is a tendency that the absolute humidity becomes higher as the temperature becomes higher.

On the other hand, when the humidity is high, the medium 99 absorbs the moisture in the air, and the moisture content of the medium 99 is high. When the moisture content of the medium 99 before performing printing is high, the total moisture content of the medium 99, which is the sum with the moisture in the liquid discharged to the medium 99, is high, facilitating the occurrence of the wrinkles 99S and floating of the medium 99, and moreover, causing the medium 99 to be hardly dried. Accordingly, in the first embodiment, printing in an environment in which the absolute humidity is not greater than the upper limit value B is recommended. Note that there is a tendency that the absolute humidity becomes lower as the temperature becomes lower.

The user operates the operation unit 170 of the host apparatus 150 or the operation unit 74 of the liquid discharge apparatus 11 to input and set the printing condition information. For example, the user performs nesting to connect a plurality of images, to create one set of the job PJ. The user also sets the number of times of printing by which the one set of the job PJ is repeatedly executed. The user further sets the set temperature of the heaters 31 to 33, the heating temperature and the blowing air volume of the drying device 40, and the ventilation air volume of the fan 51. The printing condition information contains medium size, medium type, print color, job length, number of times of printing, total job length, heater temperature, heating temperature, blowing air volume, ventilation air volume, and the like.

The user causes the medium 99 drawn from the roll body 101 loaded on the feeding unit 15 to be nipped by the rollers 25 and 26 to set the medium 99 on the transport unit 14. Before the start of the printing operation, a preparatory operation is executed until the drying device 40 is heated to a target temperature. The user also operates the operation unit 170 of the host apparatus 150 or the operation unit 74 of the liquid discharge apparatus 11 to instruct the control unit 70 to perform the reel measurement. The motors 19 and 77 are controlled to apply a predetermined front tension based on the measurement results of the reel measurement. The motors 16 and 77 are also controlled to apply a predetermined back tension. This allows the medium 99 to be applied with a predetermined suitable tension. Note that the dust catcher 55 is installed only when necessary because the transport load due to the sliding of the curved portion 63 against the printed surface 99A causes the back tension to be greater than a suitable value, which causes an influence on the printing position accuracy.

The control sequence executed by the control unit 70 will be described below. The control unit 70, after the liquid discharge apparatus 11 is powered on, executes the control sequence illustrated in the flowchart in FIG. 10. Note that, in the control sequence, the display control unit 81 configuring the control unit 70 executes the display control of causing the display units 60 and 160 to display the display screen 91 and the like.

First, in step S11, the control unit 70 acquires an absolute humidity. The control unit 70 acquires the absolute humidity AH detected by the humidity detection unit 53. Alternatively, the control unit 70 may execute a predetermined calculation based on the relative humidity RH detected by the humidity sensor 75 configuring the humidity detection unit 53 and the temperature T (° C.) detected by the temperature sensor 76 to acquire the absolute humidity AH. Note that in the first embodiment, the processing in step S11 corresponds to one example of the "humidity detection step".

In step S12, the control unit 70 determines whether the absolute humidity is less than the lower limit value A. When the absolute humidity AH is less than the lower limit value A, the process proceeds to step S13, while when the absolute humidity AH is not less than the lower limit value A, that is, equal to or greater than the lower limit value A, the process proceeds to step S21.

In step S13, the display control unit 81 prompts adjustment of the temperature. As illustrated in FIG. 11, for example, the display control unit 81 causes the display units 60 and 160 to display the display screen 91 including the message 92 prompting adjustment to raise the temperature. As illustrated in FIG. 11, the display screen 91 displays recommended temperature condition, recommended absolute humidity condition, current temperature, and current absolute humidity, for example. The recommended absolute humidity condition is from A to B (g/m^3). In the example illustrated in FIG. 11, the recommended temperature condition is from 20 to 25° C. and the current temperature is 21° C., thus, the user performs adjustment to raise the temperature within the range of the recommended temperature condition. For example, the user operates an air conditioner to perform temperature adjustment to raise the room temperature within the range of the recommended temperature condition. Note that in the first embodiment, the processings in steps S12 and S13 correspond to one example of the "first display step".

In step S14, the control unit 70 determines whether the length of the job is less than a predetermined value. When the length of the job is not less than the predetermined value, the control unit 70 proceeds to step S15, while when the length of the job is less than the predetermined value, the control unit 70 proceeds to step S17. Note that the predetermined value corresponds to the print length that can be printed at a predetermined printing speed during the execution interval time of the discharge maintenance operation. The predetermined printing speed is the print speed employed during the execution of the job PJ.

Figure 12:
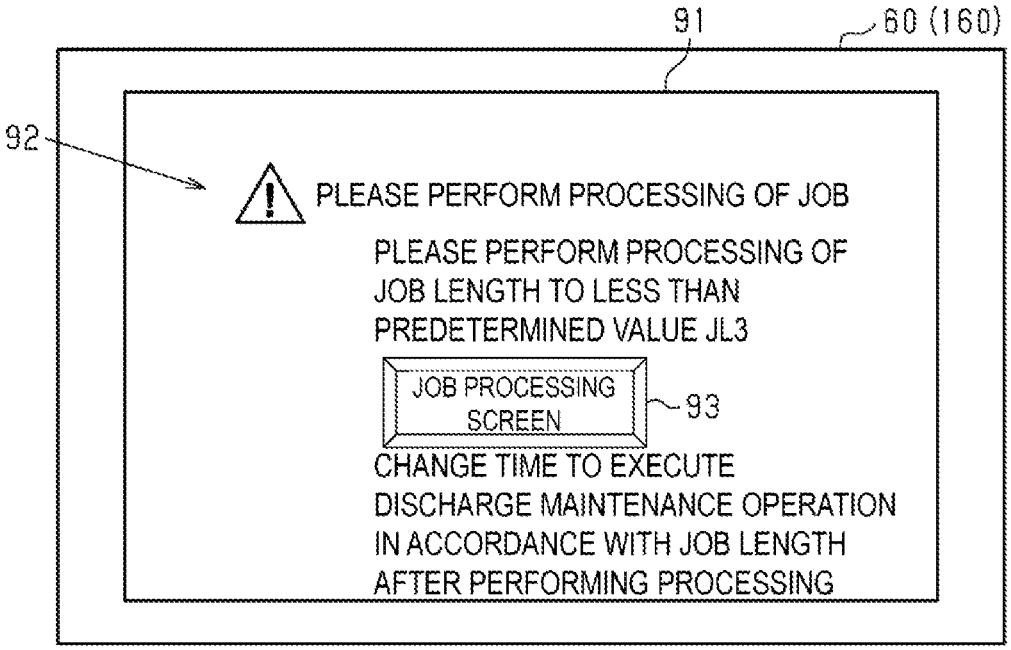
FIG. 12 is a diagram illustrating a display screen prompting processing of a job.

In step S15, the display control unit 81 prompts processing of the job. As illustrated in FIG. 12, for example, the display control unit 81 causes the display units 60 and 160 to display the display screen 91 including the message 92 prompting processing of the job. In particular, the display screen 91 includes the message 92 prompting processing of the job length to less than the predetermined value JL3. The user viewing the message 92 selects and operates a job processing screen button 93 in the display screen 91 to open a job processing screen (not illustrated), and operates the operation unit 170 on the job processing screen to perform processing of shortening the job length of the job PJ to less than the predetermined value JL3.

In the next step S16, the control unit 70 determines whether the processing of the job has been done. When the processing of the job has been done, the control unit 70 proceeds to step S17, while when the processing of the job has not been done, the control unit 70 proceeds to step S18.

In step S17, the control unit 70 performs adjustment of the time of the discharge maintenance operation. That is, the control unit 70 performs adjustment of the time of the discharge maintenance operation that the maintenance device 56 performs cleaning of the nozzles 28A of the discharge unit 28. The control unit 70 performs adjustment of the time of the discharge maintenance operation in accordance with the job length (positive determination in step S14) less than the predetermined value JL3 or the job length processed to less than the predetermined value JL3 (positive determination in step S16). That is, the control unit 70 changes the time of the discharge maintenance operation to before the start or after the termination of the job PJ, which has the job length less than the predetermined value JL3. The display control unit 81 then causes the display units 60 and 160 to display the time of the discharge maintenance operation at a predetermined display time (see FIG. 16). The timing at which the time of the discharge maintenance operation is displayed may be when the time of the discharge maintenance operation is adjusted, may be a predetermined time before the subsequent start of the printing or during printing, and may further be the timing at which the user performs a confirmation operation.

In this way, the execution interval of the discharge maintenance operation executed by the maintenance device 56 is adjusted to be short in accordance with the job length. Accordingly, the absolute humidity AH is raised by performing adjustment to raise the temperature when the absolute humidity AH is less than the lower limit value A, however, even if the absolute humidity AH remains less than the lower limit value A and does not fall within the printing environment appropriate region HA, the execution frequency of the discharge maintenance operation increases to suppress the nozzle clogging.

In step S18, the control unit 70 determines whether the discharge amount is less than a predetermined value. The discharge amount herein referred to is a discharge amount per unit area. The control unit 70 causes the liquid discharge amount acquisition unit 83 to acquire the discharge amount per unit area. The liquid discharge amount acquisition unit 83 calculates the total amount of the liquid discharged in one image based on the image data contained in the job PJ and divides the total amount of the liquid by the medium area to which the image is to be printed, to acquire the discharge amount of the liquid per unit area, that is, the amount of the liquid per unit area. Here, the predetermined value indicates a discharge amount per unit area that is small not to adversely affect the drying of the medium 99 even when humidifying the interior of the housing 12. The control unit 70 determines whether the discharge amount is less than 5 g/m^2, for example. When the discharge amount is less than the predetermined value, the control unit 70 proceeds to step S19, while when the discharge amount is not less than the predetermined value, the control unit 70 proceeds to step S20. Here, when the discharge amount is less than the predetermined value, the medium 99, to which the liquid is discharged, is easily dried. Thus, there is no issue even if humidification is performed to some extent. However, when the discharge amount is not less than the predetermined value, the medium 99 to which the liquid has been discharged is hardly dried when humidification is performed, and there is a concern in that drying of the medium 99 is inhibited. Note that in step S18, the control unit 70 may determine whether the printed image pattern is a specific pattern that can be deemed as a solid pattern, in addition to determining whether the discharge amount is less than the predetermined value. Here, the specific pattern indicates a pattern in which the occupancy of the liquid adhesion area with respect to the area of the region to be printed on the medium 99 is 80% or greater. For example, the solid pattern satisfies the condition of the specific pattern. In this case, the control unit 70 proceeds to step S20 when the discharge amount is less than the predetermined value and is not the specific pattern, and otherwise terminates the routine.

In step S19, the control unit 70 humidifies the interior of the housing 12. The control unit 70 humidifies the interior of the housing 12 by one of the two methods. One method is that the humidifier 54 provided inside the housing 12 is driven. The humidifier 54 converts water in the water reservoir section into mist or moisture vapor. The other method is that the drying device 40 is caused to heat the medium 99 under a state where the fans 45 and 51 are stopped. The third airflow AF3, which includes moisture vapor evaporated from a liquid by heating the medium 99, flows upward by a chimney effect between the drying device 40 and the downstream support portion 23 and flows into the housing 12 through the exhaust port 12B. This allows the interior of the housing 12 to be humidified. Note that the fan 51 may be driven with a small blowing air volume that does not inhibit the third airflow AF3 from flowing into the housing 12. In this case, the second airflow AF2, which is generated when the fan 51 takes a clean air into the housing 12, is mainly exhausted through the feeding port 12A, and the interior of the housing 12 is ventilated with the second airflow AF2.

Figure 13:
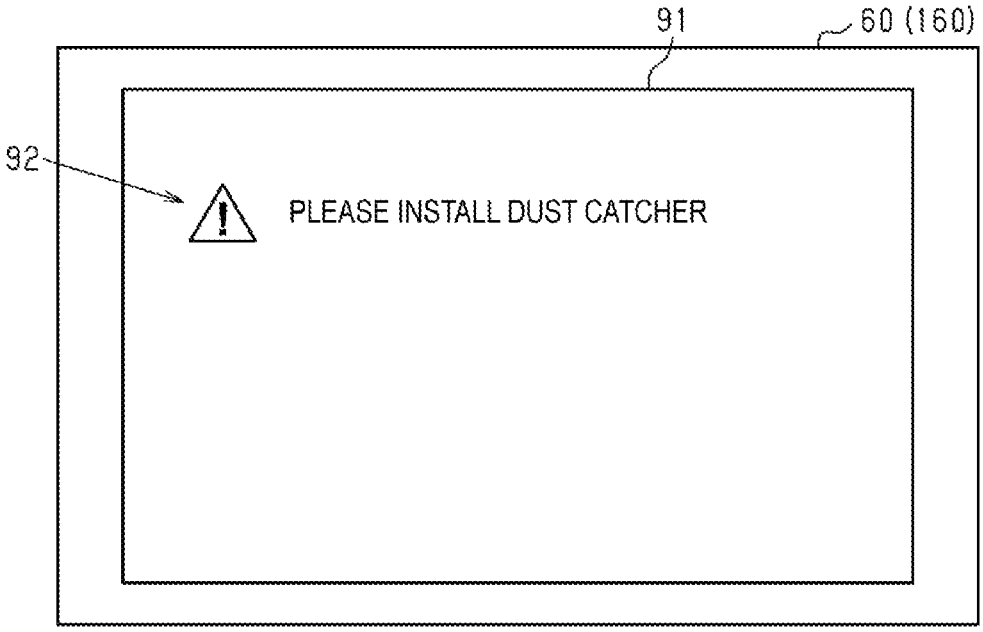
FIG. 13 is a diagram illustrating a display screen prompting installation of a dust catcher.

In step S20, the display control unit 81 displays an indication prompting installation of a dust catcher. As illustrated in FIG. 13, for example, the display control unit 81 causes the display units 60 and 160 to display the display screen 91 including the message 92 prompting installation of the dust catcher. The user viewing the message 92 installs the dust catcher 55 to the feeding port 12A of the housing 12 (see FIGS. 1 and 4).

Note that when the humidification is not performed, the control unit 70 drives the fan 51 to generate the second airflow AF2, to thus ventilate the interior of the housing 12 with a clean air, removing the foreign substances FM inside the housing 12. That is, the fan 51 is driven to cause the clean air filtered through the filter 52 to be taken into the housing 12 through the intake port 12C at the upper portion of the housing 12, and the second airflow AF2 being clean that is thus taken in flows at the periphery of the discharge unit 28, thus removing the foreign substances FM from the periphery of the discharge unit 28. This makes the foreign substances FM hardly adhere to the discharge unit 28.

In step S21, the control unit 70 determines whether the absolute humidity exceeds the upper limit value B. When the absolute humidity AH exceeds the upper limit value B, the control unit 70 proceeds to step S22, while when the absolute humidity is not greater than the upper limit value B, the control unit 70 terminates the routine. That is, when the absolute humidity AH falls within the printing environment appropriate region HA in which the absolute humidity is not less than the lower limit value A and not greater than the upper limit value B, and is an absolute humidity suitable for printing, the control unit 70 terminates the routine.

Figure 14:
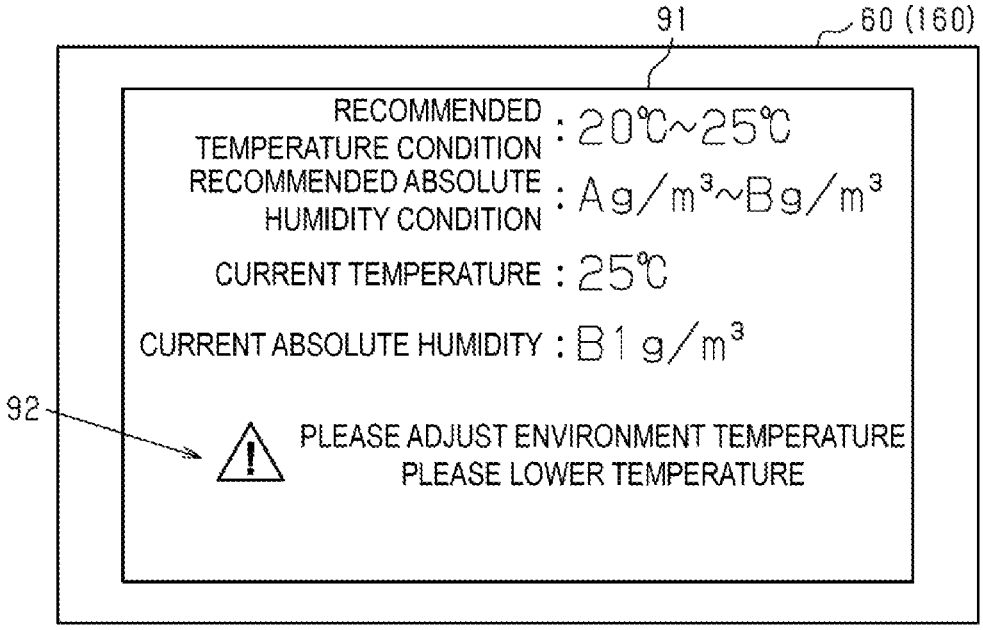
FIG. 14 is a diagram illustrating a display screen including an indication prompting adjustment of a temperature when a humidity exceeds an upper limit value.

In step S22, the display control unit 81 prompts adjustment of the temperature. As illustrated in FIG. 14, for example, the display control unit 81 causes the display units 60 and 160 to display the display screen 91 including the message 92 prompting adjustment of the temperature to lower. The display screen 91 illustrated in FIG. 14 displays recommended temperature condition, recommended absolute humidity condition, current temperature, and current absolute humidity, for example. The recommended absolute humidity condition is from A to B (g/m^3). In the example illustrated in FIG. 14, the recommended temperature condition is from 20 to 25° C. and the current temperature is 25° C., thus, the user performs adjustment to raise the temperature within the range of the recommended temperature condition. For example, the user operates the air conditioner to perform temperature adjustment to lower the room temperature within the range of the recommended temperature condition. Note that when performing the temperature adjustment prompted by the message 92 of the display screen 91 in steps S13 and S22, and when the absolute humidity cannot be adjusted within the range from A to B (g/m^3) within the recommended temperature range, the temperature may be adjusted to a temperature deviated from the recommended temperature, as long as the temperature falls within the recommended temperature range. Further, in the first embodiment, the processings in steps S21 and S22 correspond to one example of the "second display step".

In step S23, the control unit 70 determines whether the medium 99 is of a specific medium type. Specifically, the medium type determination unit 82 determines whether the medium 99 is of a specific medium type. Here, the specific medium type refers to the medium 99 such as a paper of thin thickness. For example, the specific medium type refers to a medium such as a thin paper with basis weight of 90 g/m^2 or less. In case of the thin paper, the liquid content ratio, which is the ratio of the amount of a liquid such as ink occupying in the volume of the medium 99 is high. Thus, the wrinkles 99S easily occur due to the large amount of expansion and contraction when the medium 99 expanded in the swelling process contracts during the drying process. When the medium 99 is of the specific medium type, the control unit 70 proceeds to step S24, while when not of the specific medium type, the control unit 70 terminates the routine.

In step S24, the control unit 70 determines whether the discharge amount is less than the predetermined value. The control unit 70 causes the liquid discharge amount acquisition unit 83 to acquire the discharge amount per unit area. For example, the control unit 70 determines whether the discharge amount per unit area is less than 10 g/m^2. When the discharge amount is less than the predetermined value, the control unit 70 proceeds to step S25, while when the discharge amount is not less than the predetermined value, the control unit 70 proceeds to step S26. Note that in step S24, the control unit 70 may determine whether the printed image pattern is the specific pattern that can be deemed as a solid pattern, in addition to determining whether the discharge amount is less than the predetermined value. Here, the specific pattern indicates a pattern in which the occupancy of the liquid adhesion area with respect to the area of the medium 99 is 80% or greater. For example, the solid pattern satisfies the condition of the specific pattern. In this case, the control unit 70 proceeds to step S26 when the discharge amount is not less than the predetermined value and the printed image pattern is the specific pattern.

In step S25, the control unit 70 lowers the heater temperature. When the medium 99 is of a medium type other than the specific medium type, the medium 99 to which only the liquid discharged at the discharge amount of less than the predetermined value adheres, when heated at a prescribed heat-set temperature, contracts greatly, facilitating the occurrence of the wrinkles 99S. Accordingly, the heater temperature is lowered to suppress the occurrence of the wrinkles 99S due to the drying shrinkage of the medium 99. Here, the heater temperature may be the heat-set temperature of the heaters 31 to 33 without being limited to the heat-set temperature of the heater tube 41 of the drying device 40. Any one, any two, any three, or all of the heater temperatures from among the heater tube 41 and the heaters 31 to 33 may be lowered. In particular, it is preferred that the heat-set temperature of one or both of the drying device 40 and the afterheater 33 be lowered. Further, the lowering of the heater temperature is not limited to reducing the amount of current supplied to the heater, and may include a lowering of the temperature that does not energize the heater, that is, the heater temperature is lowered to the room temperature, for example. Note that, in a configuration in which the user needs to manually adjust the heater temperature, the display control unit 81 may cause the display units 60 and 160 to display a display screen including a message prompting the heater temperature to be lowered. In this case, the user operates the operation unit 74 or 170 to perform adjustment to lower the heater temperature with respect to the liquid discharge apparatus 11.

In step S26, the control unit 70 determines whether the roll diameter is less than a predetermined value. The control unit 70 acquires the roll diameter of the roll body 102 at present from the roll diameter measuring unit 84. The control unit 70 determines whether the current roll diameter is less than a predetermined value WD4. The predetermined value WD4 is the lower limit value of the range of the roll diameter, which facilitates the occurrence of the lateral displacement of the medium 99 when the roll diameter becomes not less than this value, or is a roll diameter shorter than the lower limit value by a predetermined margin length. The predetermined value WD4 may be set as a common value among a plurality of medium types, or may be set as individual values corresponding to the medium types. When the roll diameter is less than the predetermined value WD4, the process proceeds to step S27, while when the roller diameter is not less than the predetermined value WD4, the process proceeds to step S28.

In step S27, the control unit 70 reduces the winding force. Specifically, the control unit 70 performs control to reduce the rotational speed or rotational torque of the winding motor 19, and by thus reducing the winding force, reduces the front tension exerted on the medium 99 at the portion between the transport unit 14 and the winding unit 17. This makes it possible to suppress the occurrence of the wrinkles 99S in the medium 99. Note that in step S27, the control unit 70, in place of the front tension or in addition to the front tension, may control the feeding motor 16 to reduce the back tension exerted on the medium 99 at the portion between the feeding unit 15 and the transport unit 14. Note that, in a configuration in which the user needs to manually reduce the winding force and to perform adjustment, the display control unit 81 may cause the display unit 60 or 160 to display a message prompting reduction of the winding force. The user viewing the message operates the operation unit 74 or 170 to instruct the liquid discharge apparatus 11 to reduce the winding force.

In step S28, the display control unit 81 prompts change of the total job length. Here, when the roll diameter of the roll body 102 is large, which is not less than the predetermined value WD4, a lateral displacement easily occurs between the layers in the medium 99 wound in a plurality of layers in a rolled form. The lateral displacement of the medium 99 during winding causes the occurrence of the wrinkles 99S that extend in the longitudinal direction in the medium 99, and when the wrinkles 99S propagate upstream to the vicinity of the position facing the discharge unit 28, a printing failure may be caused. Further, in the roll body 102, there is a tendency that the roll diameter becomes greater in the range of the predetermined value WD4 or greater, then the amount of the lateral displacement becomes greater. Then, the display control unit 81, when the current roll diameter is not less than the predetermined value WD4, displays an indication prompting the total job length to be shortened in order to prevent the lateral displacement or suppress the lateral displacement to a small degree.

Figure 15:
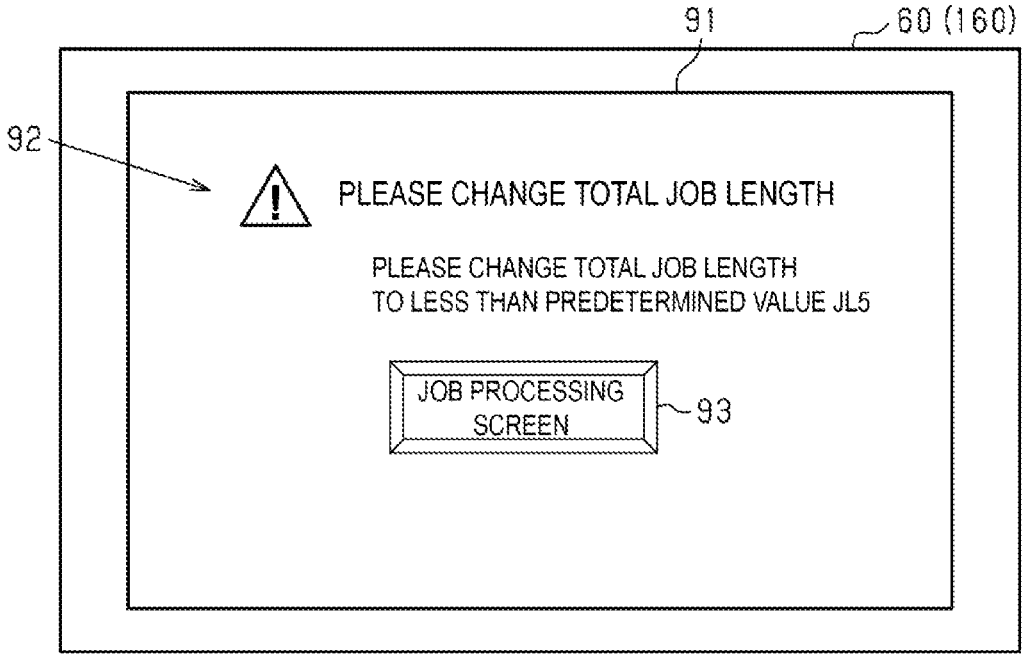
FIG. 15 illustrates a display screen prompting change of a length of a total job.

As illustrated in FIG. 15, for example, the display control unit 81 causes the display units 60 and 160 to display the display screen 91 including the message 92 prompting change of the total job length. In the example illustrated in FIG. 15, the message 92 prompting change of the total job length to less than the predetermined value JL5 is included. Note that the content of the message may be changed as appropriate, as long as the message 92 is synonymous with the change of the total job length to less than the predetermined value JL5, For example, an indication may be displayed that the remaining print length to be printed by the job PJ being executed or the print length to be printed when the job PJ to be executed is executed is to be shortened to less than the allowable print length that can suppress the lateral displacement. At this time, the indication may be an indication prompting the job length to be shortened to less than a certain number of meters, or may be an indication prompting the number of times of printing of the job to be reduced to less than the allowable number of times of printing. In this case, the allowable print length corresponds to one example of the fifth predetermined value.

The user viewing the message 92 operates the job processing screen button 93 in the display screen 91 to open the job processing screen. The user operates the operation unit 74 or 170 on the job processing screen, to change the job length of the job PJ being executed to be short if printing is being performed, and to change the job length of the job PJ to be executed to be short if printing is to be performed. Examples of the change of the job length include reprocessing the job to shorten the content of the job as is, reducing the number of times of printing of the job, and the like. In this way, the user changes the total job length to be short. The control unit 70, upon receiving the operation signal that the user operates to change the job length, updates the job length of the job PJ being executed or the job length of the job PJ to be executed to the changed value, and updates the total job length in conjunction with the updating of the job length.

This allows the printing to be performed with the changed total job length. The roll diameter of the roll body 102 wound around the winding unit 17 does not become excessively large because the total job length is not excessively long, which prevents the lateral displacement from occurring in the medium 99. This makes it possible to suppress an occurrence of the wrinkles 99S, a printing failure, a winding displacement of the roll body 102, and the like due to the lateral displacement of the medium 99.

Figure 16:
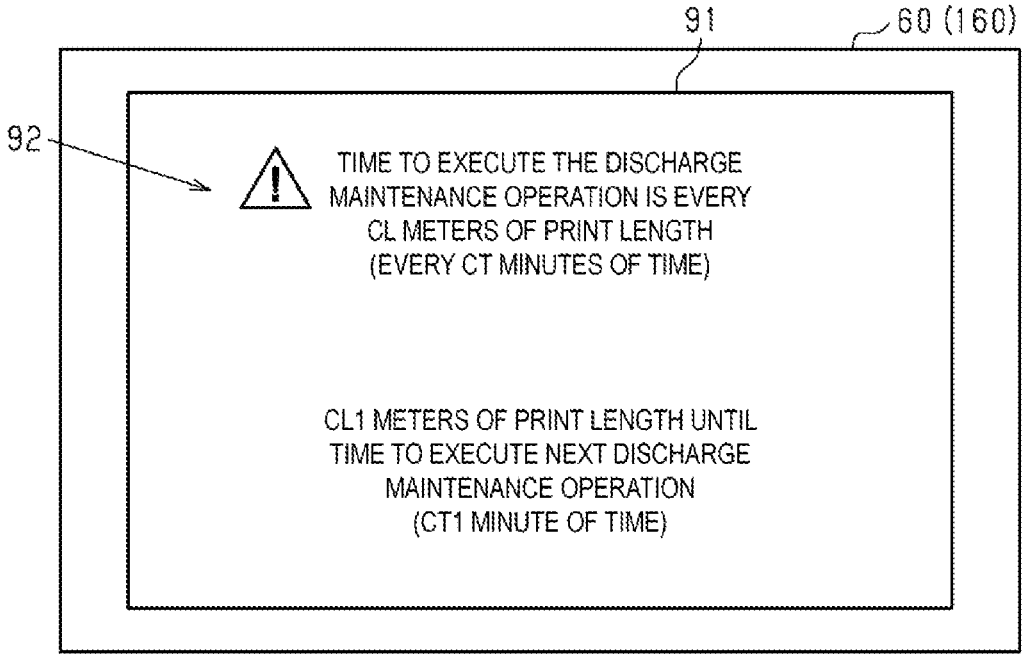
FIG. 16 is a diagram illustrating a display screen notifying a time to execute a discharge maintenance operation.

Further, the display control unit 81 causes the display units 60 and 160 to display the display screen 91 indicating the time to execute the discharge maintenance operation illustrated in FIG. 16 at a suitable time during printing. The display screen 91 illustrated in FIG. 16 displays the message 92 containing that the time to execute the discharge maintenance operation is every CL meters of print length or every CT minutes of time, and that the print length, which is the remaining length over which printing can be performed until the time when the next discharge maintenance operation is executed is the CL1 meter, or that the remaining time during which printing can be performed until the time when the next discharge maintenance operation is executed is the CT1 minute of time. The user viewing the message 92 can confirm the time when the next discharge maintenance operation is executed.

As described above in detail, according to the first embodiment, the following advantageous effects are achieved.

(1) The liquid discharge apparatus 11 includes the transport unit 14 configured to transport the medium 99, the discharge unit 28 configured to discharge a liquid onto the medium 99, and the humidity detection unit 53 configured to detect a humidity. The liquid discharge apparatus 11 includes the display control unit 81 configured to display an indication prompting adjustment of the temperature when the humidity detection unit 53 detects a humidity less than the lower limit value A (one example of the first predetermined value) or when the humidity detection unit 53 detects a humidity exceeding the upper limit value B (one example of the second predetermined value) greater than the lower limit value A. Thus, the user can be notified that the humidity has deviated from a suitable range. The user adjusts the temperature in accordance with the indication prompting adjustment of the temperature or humidity. This allows the humidity to be adjusted to a suitable range of not less than the lower limit value A or not greater than the upper limit value B. For example, this makes it possible to suppress the clogging in the discharge unit 28 due to the foreign substances FM such as dust and fluff that are easily suspended in the air when the humidity is low, which is less than the lower limit value A. In this case, the printing failure due to the discharge failure caused by the clogging in the discharge unit 28 is suppressed. Further, for example, the wrinkles S99 of the medium 99 that easily occur when the humidity exceeds the upper limit value B are suppressed. In this case, the printing failure that occurs when a liquid is discharged to the wrinkles 99S of the medium 99 or the wrinkles 99S are rubbed against the discharge unit 28 is suppressed.

(2) The display control unit 81, when the humidity detection unit 53 detects a humidity less than the lower limit value A, displays an indication prompting the length of the job PJ to be executed by the discharge unit 28 and the transport unit 14 to be less than the predetermined value JL3

(one example of the third predetermined value) shorter than a predetermined job length allowed when the humidity detection unit 53 detects a humidity being not less than the lower limit value A. Thus, the user can be notified of a countermeasure to be conducted in order to suppress the printing failure caused by the clogging in the discharge unit 28 while suppressing the printing failure due to the execution of the discharge maintenance operation during printing. For example, the user sets the length of the job to be shorter than the predetermined value JL3. This makes it possible to increase the execution frequency of the discharge maintenance operation while avoiding the execution of the discharge maintenance operation during the execution of printing of the job PJ. Thus, this makes it possible to suppress the printing unevenness due to the execution of the discharge maintenance operation during printing of the image and the printing failure caused by the clogging in the discharge unit 28, for example.

(3) The control unit 70, when the length of the job PJ is less than the predetermined value JL3, changes the time to execute the discharge maintenance operation of the discharge unit 28 to before the start or after the termination of the job. Thus, when the humidity detection unit 53 detects a humidity less than the lower limit value A, the time or print length until the discharge maintenance operation is executed is shortened than the value allowed when the humidity is not less than the lower limit value A, to thus suppress the printing failure caused by the clogging in the discharge unit 28.

(4) The display control unit 81, when the humidity detection unit 53 detects a humidity exceeding the upper limit value B and when the diameter of the roll body 102, which is the diameter of the medium 99 in a rolled form, is not less than the predetermined value WD4 (one example of the fourth predetermined value), displays an indication prompting change of the length of the job PJ to be executed by the discharge unit 28 and the transport unit 14. Thus, the user can be notified, by the indication, of a countermeasure to be conducted in order to suppress the lateral displacement of the medium 99, which easily occurs when the diameter of the roll body 102 is not less than the predetermined value WD4. For example, the user viewing the indication can change the length of the job PJ to suppress the lateral displacement of the medium 99. For example, this makes it possible to suppress the wrinkles 99S, the printing failure, the winding displacement, and the like due to the lateral displacement of the medium 99.

(5) The display control unit 81, when the humidity detection unit 53 detects a humidity exceeding the upper limit value B and when the diameter of the roll body 102, which is the diameter of the medium 99 in a rolled form, is not less than the predetermined value WD4, displays an indication prompting change of the length of the job PJ. The display control unit 81 displays, as the indication prompting change of the length of the job PJ, an indication prompting setting the total job length, which is the lengths of all of the jobs when the display control unit 81 causes the discharge unit 28 and the transport unit 14 to execute the job and causes the winding unit 17 to wind the medium 99 into a rolled form, to be less than the predetermined value JL5 (one example of the fifth predetermined value). The predetermined value JL5 is a value shorter than the maximum total job length allowed when the humidity detection unit 53 detects a humidity not greater than the upper limit value B, that is, when the humidity is the absolute humidity AH within the printing environment appropriate region HA. Thus, the user can be notified, by the indication, of a countermeasure for changing the length of the total job to be short in order not to cause the lateral displacement to occur in the medium 99. For example, the user viewing the indication shortens the length of the job PJ or reduces the number of time of printing of the job PJ to change the total job length to be short to less than the predetermined value JL5. This makes it possible to suppress the lateral displacement of the medium 99.

(6) The display control unit 81, based on the absolute humidity AH detected by the humidity detection unit 53, displays the time to execute the discharge maintenance operation of the discharge unit 28. Thus, the user can be notified of the time to execute the discharge maintenance operation. For example, the user can conduct a countermeasure such as for changing the length of the job PJ in accordance with the time to execute the discharge maintenance operation.

(7) The display control method for the liquid discharge apparatus 11 provides a display control method for displaying information corresponding to the humidity detected by the humidity detection unit 53 in the liquid discharge apparatus 11 including the transport unit 14 configured to transport the medium 99, the discharge unit 28 configured to discharge a liquid onto the medium 99, and the humidity detection unit 53 configured to detect a humidity. The display control method includes a humidity detection step in which the humidity detection unit 53 detects a humidity (step S11), and a first display step in which an indication is displayed prompting adjustment of the temperature or humidity when the humidity detection unit 53 detects a humidity less than the lower limit value A (steps S12 and S13). The display control method also includes a second display step in which an indication is displayed prompting adjustment of the temperature or humidity when the humidity detection unit 53 detects a humidity exceeding the upper limit value B greater than the lower limit value A (steps S21 and S22). Thus, according to the display control method, the same advantageous effect as in the liquid discharge apparatus 11 described in the above-described item (1) is achieved.

Second Embodiment

Figure 17:
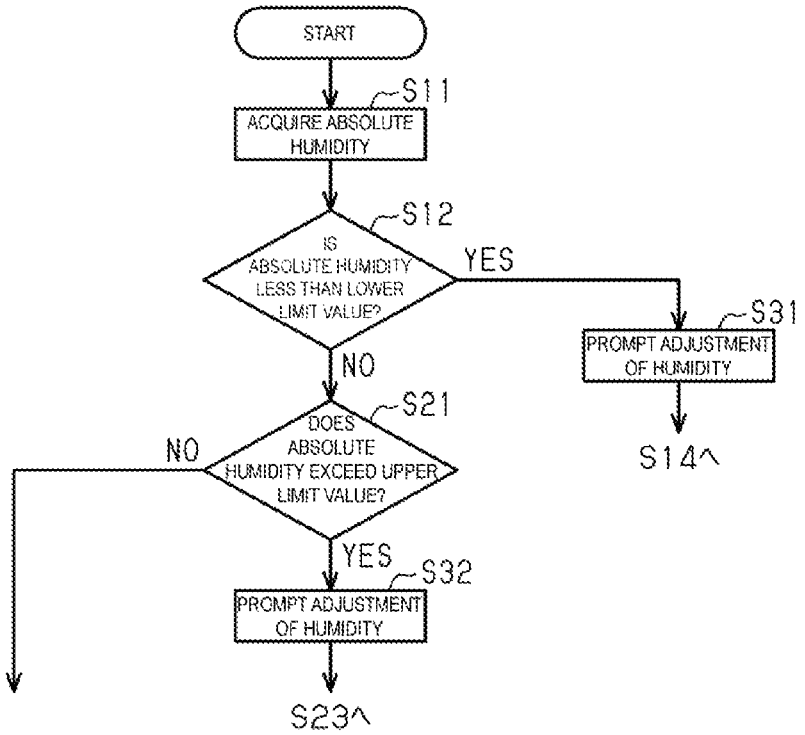
FIG. 17 is a flowchart illustrating a control sequence of performing control based on environmental information during printing in a second embodiment.
Figure 18:
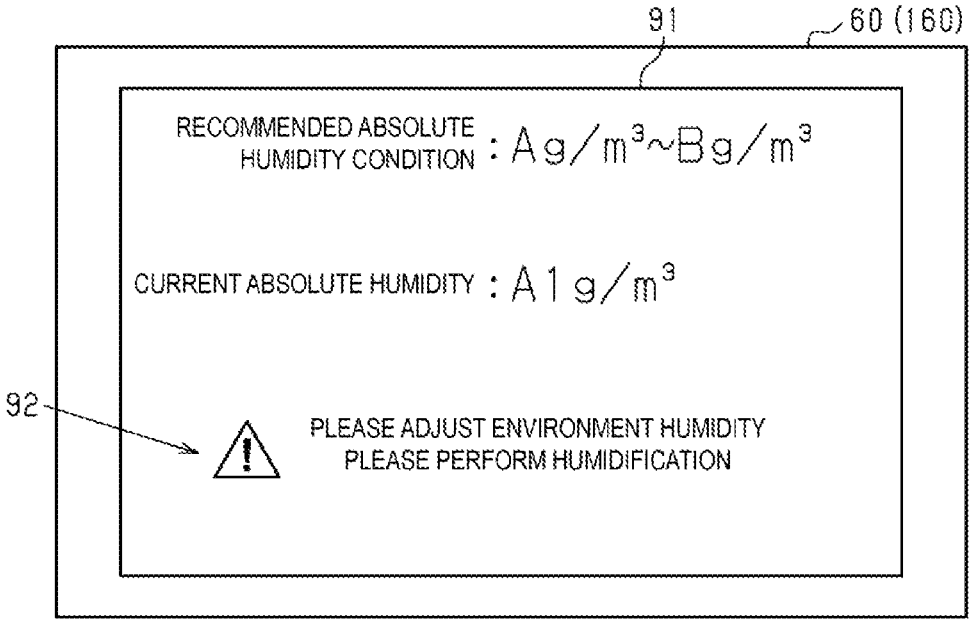
FIG. 18 is a diagram illustrating a display screen including an indication prompting adjustment of a humidity when a humidity is less than a lower limit value.
Figure 19:
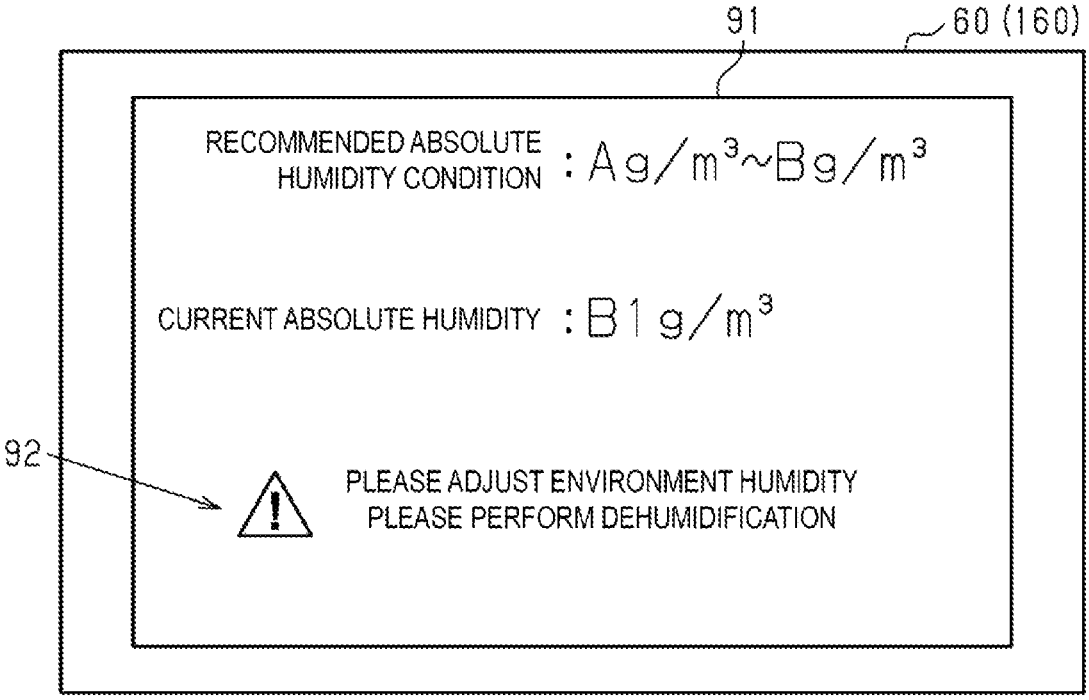
FIG. 19 is a diagram illustrating a display screen including an indication prompting adjustment of a humidity when a humidity exceeds an upper limit value.

Next, the second embodiment will be described below with reference to FIGS. 17 to 19. The configuration of the liquid discharge apparatus 11 is the same as in the first embodiment. In the above-described first embodiment, the display control unit 81 displays an indication prompting adjustment of the temperature, however, in the second embodiment, the display control unit 81 displays an indication prompting adjustment of the humidity. That is, the display control unit 81, when the humidity detection unit 53 detects the absolute humidity AH less than the lower limit value A, displays an indication prompting adjustment of the humidity, and when the absolute humidity AH exceeds the upper limit value B, displays an indication prompting adjustment of the humidity. FIG. 17 illustrates a part of processing different from that of FIG. 10 in the above-described first embodiment, and the processing omitted in FIG. 17 is the same as the processing in FIG. 10.

As illustrated in FIG. 17, when the absolute humidity AH acquired in step S11 is less than the lower limit value A, the display control unit 81 displays, in step S31, an indication prompting adjustment of the humidity. As illustrated in FIG. 18, for example, the display control unit 81 causes the display units 60 and 160 to display the display screen 91 including the message 92 prompting the humidity to be raised. The user viewing the display screen 91 can be notified that the absolute humidity AH has deviated from the lower limit value A of the printing environment appropriate region HA. In addition, the user can be notified of a method necessary for adjusting the absolute humidity AH to fall within the printing environment appropriate region HA. Accordingly, the user instructs the liquid discharge apparatus 11 to drive the humidifier 54 through operation of the operation unit 74 or 170. Alternatively, the user operates the operation unit 74 or 170 to instruct the liquid discharge apparatus 11 to drive the drying device 40 and the like in the humidification mode for delivering the third airflow AF3 containing moisture vapor into the housing 12, as illustrated in FIG. 9. In the humidification mode, by providing a command to energize and heat the heater tube 41 in a state of stopping the air blowing fan 45 of the drying device 40, the third airflow AF3 containing moisture vapor evaporated from the liquid adhering to the medium 99 is delivered into the housing 12. Further, the user may drive a humidifier of another apparatus installed in the vicinity of the liquid discharge apparatus 11 to raise the absolute humidity at the periphery or in the interior of the liquid discharge apparatus 11. As a result of the humidification, at least the absolute humidity AH inside the housing 12 rises, thus, the foreign substances FM suspended in the air inside the housing 12 settle out, suppressing the charge of the foreign substances FM. This facilitates to avoid conducting a countermeasure for preventing nozzle clogging, which the job length of the job PJ is shortened or the dust catcher 55 is installed, achieving a printing operation with high print quality and high productivity.

Further, in step S21, when the control unit 70 determines that the absolute humidity exceeds the upper limit value, the display control unit 81 displays, in step S32, an indication prompting control of the humidity. As illustrated in FIG. 19, for example, the display control unit 81 causes the display units 60 and 160 to display the display screen 91 including the message 92 prompting the humidity to be lowered. The user viewing the display screen 91 can be notified that the absolute humidity AH has deviated from the upper limit value B of the printing environment appropriate region HA. The user can also be notified of a method necessary for adjusting the absolute humidity AH to fall within the printing environment appropriate region HA.

When the liquid discharge apparatus 11 is configured to include a dehumidifier, the user viewing the display screen 91 operates the operation unit 74 or 170 to instruct the liquid discharge apparatus 11 to drive the dehumidifier. Further, the user may drive a dehumidifier of another apparatus disposed at the periphery or in the interior of the liquid discharge apparatus 11 to lower the absolute humidity at the periphery or in the interior of the liquid discharge apparatus 11. As a result of the dehumidification, the absolute humidity AH inside and outside the housing 12 lowers, facilitating drying of the medium 99 after performing printing. In addition, this makes it possible to suppress the occurrence of the wrinkles 99S without reducing the tension exerted on the medium 99, or without applying or enhancing the suction force of the suction mechanism 30, thus, an image and the like can be printed on the medium 99 with high print quality. Note that in step S21, when the control unit 70 determines that the absolute humidity is not greater than the upper limit value B (negative determination in step S21), the control unit 70 terminates the routine. That is, when the absolute humidity AH falls within the printing environment appropriate region HA in which the absolute humidity is not less than the lower limit value A and not greater than the upper limit value B, and is an absolute humidity suitable for printing, the control unit 70 terminates the routine as in the above-described first embodiment.

Note that the above-described embodiments may also be modified as embodiments in the following modifications. Moreover, the combinations as appropriate of the above-described embodiments and the modifications described below can be further modifications, and the combinations as appropriate of the modifications described below can be further modifications.

In step S12, when it is determined that the absolute humidity AH is less than the lower limit value A, the display control unit 81 may display a countermeasure for reducing foreign substances when the absolute humidity AH remains less than the lower limit value A even if the user viewing the message 92 of the display screen 91 performs temperature adjustment. For example, the display control unit 81 may display an indication prompting the humidifier 54 to be driven. Alternatively, the display control unit 81 may display an indication prompting a humidification function for humidifying the interior of the housing 12 by a chimney effect of the drying device 40 to be driven. For example, in step S19, the display control unit 81 may display an indication prompting the interior of the housing 12 to be humidified.

When the humidity detection unit 53 detects the absolute humidity AH exceeding the upper limit value B, the display control unit 81 may display an indication prompting the length of the job PJ to be shortened to less than a predetermined value. When the length of the job PJ is excessively longer than the predetermined value, the errors between the target tension and the actual tension over the tension control for controlling the tension exerted on the medium 99 accumulate, and when the cumulative errors exceed a predetermined value, an excessive tension may be exerted on the medium 99. Accordingly, when the humidity detection unit 53 detects the absolute humidity AH exceeding the upper limit value B, the display control unit 81 displays an indication prompting the length of the job PJ to be shortened to less than the predetermined value when the length of the job PJ is excessively long.

In step S21, when the humidity detection unit 53 detects the absolute humidity AH exceeding the upper limit value B, or when the absolute humidity AH remains exceeding the upper limit value B even if the user lowers the temperature, the display control unit 81 may display an indication prompting the heat-set temperature of the preheater 31 to be raised. The user viewing the indication can be notified of a method for suppressing the occurrence of the wrinkles 99S in the medium 99. By raising the temperature of the preheater 31, the moisture content of the portion of the medium 99 before performing printing is reduced, and the total moisture content of the medium 99 after performing printing is relatively reduced, thus reducing the amount of expansion and contraction of the medium 99 after performing printing, to suppress the occurrence of the wrinkles 99S.

In step S26, both the roll diameter used for the determination to reduce the winding force and the roll diameter used for the determination whether to prompt change of the total job length are the current roll diameter, however, at least, the roll diameter used to determine whether to prompt change of the total job length may be the roll diameter obtained by calculating the roll diameter when completing the winding of the medium 99 of the total job length. For example, in step S26, the control unit 70 calculates the roll diameter of the roll body 102 when completing the execution of all of the jobs (total job) for the job PJ being executed or the job PJ to be executed. The control unit 70 then determines whether the roll diameter is less than a predetermined value WD4. The predetermined value WD4 is a value that facilitates the occurrence of the lateral displacement of the medium 99 when the roll diameter becomes not less than this value. When the roll diameter is less than the predetermined value WD4, the control unit 70 acquires the current roll diameter from the roll diameter measuring unit 84, and acquires the remaining allowable printing length that is allowed from the current roll diameter until the roll diameter of the predetermined value RD4. The display control unit 81 then displays an indication prompting the remaining print length defined by the job PJ being executed or to be executed to be shortened to less than the allowable print length. In this case, an indication prompting the job length to be shortened to less than a certain number of meters may be displayed, and an indication prompting the number of times of printing of the job to be reduced to less than a certain number of times may be displayed. The above configuration allows the user to have an opportunity to change the total job length to be short at an earlier timing, and thus, for example, the job length of the job PJ can be changed to be short before the start of the printing operation or at an earlier stage after the start of the printing operation, thus enabling to set a total job that the roll diameter is suppressed to less than the predetermined value WD4. This makes it possible to cope with an unmanned operation as well.

In one or both of steps S27 and S28, the display control unit 81 may display an indication prompting a force in a direction approximating the medium 99 to the support portion 22 to be applied or prompting the force to be intensified. For example, the display control unit 81 displays an indication prompting the suction mechanism 30 to be driven, or an indication prompting change of the suction force of the suction mechanism 30 to the high force side. In this case, the occurrence of the wrinkles 99S in the medium 99 is suppressed by causing the medium 99 to be suctioned to the support surface 22A or to be suctioned to the support surface 22A with a suction force stronger than the normal suction force. In this regard, the suction mechanism 30 functions as a force applying unit configured to apply a force in the direction approximating the medium 99 to the support portion 22 to the medium 99. In addition, when the liquid discharge apparatus 11 is a textile printing machine, the display control unit 81 may display an indication prompting the pressing force of the pasting roller for transferring the print surface of the medium 99 to a cloth to be enhanced. In this case, a countermeasure for suppressing the occurrence of the wrinkles 99S can be displayed to notify the user. The user viewing the indication operates the operation units 74 and 170 to enhance the pressing force of the pasting roller, then, the medium 99 is pressed against the support surface 22A, thus suppressing the occurrence of the wrinkles 99S in the medium 99. Here, the reason why the suction mechanism 30 is not immediately driven upon the absolute humidity AH exceeding the upper limit value B lies in that the transport resistance of the medium 99 may be increased to reduce the transport position accuracy of the medium 99. Accordingly, it is favorable to display an indication prompting the suction mechanism 30 to be driven or prompting the suction force to be intensified, determining whether other conditions are satisfied in case when the absolute humidity AH exceeds the upper limit value B, when a countermeasure for suppressing the occurrence of the wrinkles 99S is required, when the absolute humidity AH does not become equal to or less than the upper limit value B even if the user lowers the temperature of the environment, or the like. This is also applicable to the case when enhancing the pressing force of the pasting roller when the liquid discharge apparatus 11 is a textile printing machine. Note that in step S22, the display control unit 81 may display an indication prompting a force in the direction approximating the medium 99 to the support portion 22 to be applied, or prompting the force to be intensified.

In step S27, the display control unit 81 may display an indication prompting the winding force to be reduced. Further, in step S27, the display control unit 81 may display an indication prompting one or both of the front tension and the back tension to be reduced. The user operates the operation units 74 and 170 to lower the set value of one or both of the front tension and the back tension.

In the above-described embodiments, when the absolute humidity AH deviates from the printing environment appropriate region HA, an indication about this deviation is displayed, and an indication prompting adjustment of the temperature or humidity to cause the absolute humidity AH to fall within the printing environment appropriate region HA is displayed. For example, when performing an unmanned operation, there is a possibility that the printing quality is lowered when the absolute humidity deviates from the printing environment appropriate region HA due to the fluctuation in the temperature and humidity during the unmanned operation. Accordingly, an indication prompting adjustment of the temperature or humidity may be displayed such that the absolute humidity AH, within the printing environment appropriate region HA, falls within the central range of not less than a value A2greater than the lower limit value A and not greater than a value B2 (>A2) less than the upper limit value B.

When the humidity detection unit 53 detects the absolute humidity AH exceeding the upper limit value B, the display control unit 81 may display an indication prompting the gap between the discharge unit 28 and the support surface 22A to be increased. The user viewing the indication can be notified of a countermeasure that can suppress the printing failure even if the wrinkles 99S occur. For example, the user operates the operation units 74 and 170 to change the gap to a larger value than that at the normal time when the absolute humidity AH falls within the printing environment appropriate region HA. For example, supposing that the designated printing resolution is a second resolution when performing normal printing that is lower than a first resolution when performing high definition printing, the gap is changed, by an operation of the user, to a second gap greater than the first gap being the default value. This allows, even if the wrinkles 99S occur in the medium 99, the large gap to prevent the wrinkles 99S from coming into contact with the nozzle opening surface 28B of the discharge unit 28, making it possible to prevent the printing failure of ink stain due to the rubbing. Note that in view of printing accuracy, it is preferred that, when performing high definition printing, the gap be not changed to the larger gap side from the default value at that time.

When the humidity detection unit 53 detects the absolute humidity AH exceeding the upper limit value B, the display control unit 81 may display an indication prompting change of the value of the tension that the tension bar 20 can apply to the medium 99 to the smaller tension side. The user viewing the indication can be notified of a countermeasure for suppressing the occurrence of the wrinkles 99S. For example, the user operates the operation units 74 and 170 to instruct the control unit 70 configured to electrically control the load of the tension bar 20 to change the set value of the tension to the smaller tension side. Alternatively, the user manually adjusts the position or weight of the counter balance of the tension bar 20 to adjust the value of the tension to a value less than that at the normal time.

In the second embodiment, the display control unit 81 may display an indication prompting adjustment of the absolute humidity AH, but may also display an indication prompting adjustment of the relative humidity RH. The control unit 70 can calculate a lower limit value RHA of the relative humidity RH required for the absolute humidity AH to fall within the printing environment appropriate region HA based on the temperature T detected at that time and the lower limit value A of the absolute humidity. The control unit 70 can calculate an upper limit value RHB of the relative humidity RH required for the absolute humidity AH to fall within the printing environment appropriate region HA based on the temperature T detected at that time and the upper limit value B of the absolute humidity. In the case of the former, the display control unit 81 displays an indication prompting adjustment of the relative humidity RH to not less than the lower limit value RHA. In the case of the latter, the display control unit 81 displays an indication prompting adjustment of the relative humidity RH to not greater than the upper limit value RHB.

When the humidity detection unit 53 detects a humidity less than the lower limit value A and when the humidity detection unit 53 detects a humidity exceeding the upper limit value B, the display control unit 81 may display an indication prompting adjustment of the temperature on one hand, and may display an indication prompting adjustment of the humidity on the other hand. The display control unit 81 may also display a display screen including both an indication prompting adjustment of the temperature and an indication prompting adjustment of the humidity. In this case, the user may select and adjust one that can be coped with of the temperature and humidity, and both of the temperature and humidity may be adjusted if both the temperature and humidity can be coped with.

The suction mechanism 30 may be configured to cause the medium 99 to be suctioned to the support surface 22A in a period in which the carriage 27 scans to perform a one-pass amount of printing on the medium 99, and configured not to apply negative pressure through the suction port 35 during the period of transporting the medium 99.

A dehumidification unit may be provided inside the housing 12. The dehumidification unit includes a dehumidification driver and a reservoir section, and the water generated by the dehumidification of the dehumidification driver is retained in the reservoir section. The dehumidification driver of any scheme may be used, such as compressor scheme, desiccant scheme, Pelter's scheme using an electronic cooling element (Peltier element), electrolysis scheme for performing dehumidification accompanying electrolysis of moisture using a solid polymeric electrolyte.

A humidity adjustment unit that has both dehumidification function and humidification function may be provided. In this case, the driver may be provided with a dehumidification driver and a humidification driver separately, or may include one driver that has both dehumidification function and humidification function. In the case of the latter, the electrolysis scheme is used for the driver, for example. Note that examples of the moisture used for the humidification include highly humid air generated by the dehumidification, or highly humid air above the water surface inside the reservoir section, without being limited to water.

The drying device 40 may only have a function to dry the medium 99 by fan-blowing. Further, the liquid discharge apparatus 11 may be devoid of the drying device 40 and configured to perform drying by the afterheater 33.

The liquid discharge apparatus 11 may transport the medium 99 after performing printing to another apparatus provided with a winding device. In addition, the liquid discharge apparatus 11 may be devoid of the feeding unit 15, and configured to include the discharge unit 28 configured to discharge a liquid onto the medium 99 fed from the feeding unit 15 provided in another apparatus.

The transport path is not limited to a trapezoidal transport path in a side view, and may have any path shape such as an entirely flat transport path that extends horizontally.

The medium 99 is not limited to a paper, and may be a film or sheet made of synthetic resin, a cloth, a nonwoven fabric, a laminate sheet, or the like.

The liquid discharge apparatus 11 may be a complex device having a scanner function and a copy function, in addition to the printing function.

Hereinafter, technical concepts recognized from the above-described embodiments and modifications will be described along with the advantageous effects.

A liquid discharge apparatus includes a transport unit configured to transport a medium, a discharge unit configured to discharge a liquid onto the medium, a support portion that supports a portion of the medium, the liquid being discharged from the discharge unit onto the portion of the medium, a housing including therein the discharge unit, a humidity detection unit configured to detect a humidity, and a display control unit configured to display an indication prompting adjustment of a temperature or humidity when the humidity detection unit detects a humidity less than a first predetermined value, and configured to display an indication prompting adjustment of a temperature or humidity when the humidity detection unit detects a humidity exceeding a second predetermined value greater than the first predetermined value.

According to the above configuration, when the humidity detection unit detects a humidity less than the first predetermined value, an indication prompting adjustment of the temperature or humidity is displayed, and when the humidity detection unit detects a humidity exceeding a second predetermined value greater than the first predetermined value, an indication prompting adjustment of the temperature or humidity is displayed. Thus, the user can be notified that the humidity has deviated from a suitable range. The user adjusts the temperature or humidity in accordance with an indication prompting adjustment of the temperature or humidity. This allows the humidity to be adjusted to a suitable range of not less than the first predetermined value or not greater than the second predetermined value. For example, this makes it possible to suppress the clogging in the discharge unit due to the foreign substances such as dust and fluff that are easily suspended in the air when the humidity is low, which is less than the first predetermined value. In this case, the printing failure due to the discharge failure caused by the clogging in the discharge unit is suppressed. In addition, for example, the wrinkles of the medium that easily occur when the humidity exceeds the second predetermined value are suppressed. In this case, the printing failure that occurs when a liquid is discharged to the wrinkles of the medium or the wrinkles are rubbed against the discharge unit is suppressed.

In the above-described liquid discharge apparatus, when the humidity detection unit detects a humidity less than the first predetermined value, the display control unit may display an indication prompting setting a length of a job to be executed by the discharge unit and the transport unit to be less than a third predetermined value.

According to the above configuration, the user can be notified of a countermeasure to be conducted in order to suppress the printing failure caused by the clogging in the discharge unit while suppressing the printing failure due to the execution of the discharge maintenance operation during printing. The user may set the length of the job to be shorter than the third predetermined value. This makes it possible to suppress the printing unevenness due to the execution of discharge maintenance operation during printing of the image and the printing failure caused by the clogging in the discharge unit, for example.

The liquid discharge apparatus may include a control unit configured to change a timing, at which a discharge maintenance operation of the discharge unit is executed, to before a start of a job or after a completion of the job when the length of the job is less than the third predetermined value.

According to the above configuration, when the length of the job is less than the third predetermined value, the timing, at which the discharge maintenance operation is executed, is changed to perform the discharge maintenance operation of the discharge unit before the start of or after the job. This allows the discharge maintenance operation of the discharge unit to be performed before the start of or after the job having a length less than the third predetermined value. The time or the print length until the discharge maintenance operation is executed may be shortened compared to a value allowed when the humidity is not less than the first predetermined value. For example, the printing failure caused by the clogging in the discharge unit is suppressed.

The liquid discharge apparatus may further include a winding unit configured to wind the medium, onto which a liquid is discharged from the discharge unit, in a rolled form, wherein the display control unit may display an indication prompting change of the length of the job to be executed by the discharge unit and the transport unit, when the humidity detection unit detects a humidity exceeding the second predetermined value and when a diameter of the medium in a rolled form is not less than a fourth predetermined value.

According to the above configuration, the user can be notified, by the indication, of a countermeasure to be conducted in order to suppress a lateral displacement of the medium 99 that easily occurs when the diameter of the medium 99 in a rolled form is not less than the fourth predetermined value. For example, the user viewing the indication can change the length of the job to suppress the lateral displacement of the medium.

In the above-described liquid discharge apparatus, the indication prompting change of the length of the job may be an indication prompting setting a total job length for all of jobs to be less than a fifth predetermined value, the jobs being executed when the discharge unit and the transport unit are to be executed to wind the medium into a rolled form around the winding unit.

According to the above configuration, the user can be notified, by the indication, that the total job length is shortened to less than the fifth predetermined value as a countermeasure to be conducted in order to suppress a lateral displacement of the medium. For example, the user viewing the indication adjusts the total job length to be short to less than the fifth predetermined value. This makes it possible to suppress a lateral displacement of the medium that easily occurs when the diameter of the medium wound in a rolled form becomes not less than the fourth predetermined value.

In the above-described liquid discharge apparatus, the display control unit may be configured to display a time to execute a discharge maintenance operation of the discharge unit based on the humidity detected by the humidity detection unit.

According to the above configuration, the user can be notified of the time to execute the discharge maintenance operation. For example, this makes it possible to conduct a countermeasure for changing the length of the job in accordance with the time to execute the discharge maintenance operation.

A display control method for a liquid discharge apparatus is a display control method for the liquid discharge apparatus including a transport unit configured to transport a medium, a discharge unit configured to discharge a liquid onto the medium, and a humidity detection unit configured to detect a humidity, the liquid discharge apparatus displaying information corresponding to the humidity, the display control method including: a humidity detection step for detecting a humidity by the humidity detection unit, a first display step for displaying an indication prompting adjustment of a temperature or humidity when the humidity detection unit detects a humidity less than a first predetermined value, and a second display step for displaying an indication prompting adjustment of a temperature or humidity when the humidity detection unit detects a humidity exceeding a second predetermined value greater than the first predetermined value. According to the above configuration, the same advantageous effect as in the above-described liquid discharge apparatus is achieved.

What is claimed is:

1. A liquid discharge apparatus comprising:

a transport unit configured to transport a medium;

a discharge unit configured to discharge a liquid onto the medium;

a support portion configured to support a portion of the medium, the liquid being discharged from the discharge unit onto the portion of the medium;

a housing including therein the discharge unit;

a humidity detection unit configured to detect a humidity; and a display control unit configured to display an indication prompting adjustment of a temperature or humidity when the humidity detection unit detects a humidity less than a first predetermined value, and configured to display an indication prompting adjustment of a temperature or humidity when the humidity detection unit detects a humidity exceeding a second predetermined value greater than the first predetermined value, wherein when the humidity detection unit detects a humidity less than the first predetermined value, the display control unit displays an indication prompting a user to set a length of a job, that is to be executed by the discharge unit and the transport unit, to be less than a third predetermined value.

2. The liquid discharge apparatus according to claim 1, comprising a control unit configured to change a timing, at which a discharge maintenance operation of the discharge unit is executed, to before a start of the job or after a completion of the job when the length of the job is less than the third predetermined value.

3. The liquid discharge apparatus according to claim 1, wherein the display control unit is configured to display a timing, at which a discharge maintenance operation of the discharge unit is executed, based on the humidity detected by the humidity detection unit.

4. A liquid discharge apparatus comprising:

a transport unit configured to transport a medium;

a discharge unit configured to discharge a liquid onto the medium;

a support portion configured to support a portion of the medium, the liquid being discharged from the discharge unit onto the portion of the medium;

a housing including therein the discharge unit;

a humidity detection unit configured to detect a humidity;

a display control unit configured to display an indication prompting adjustment of a temperature or humidity when the humidity detection unit detects a humidity less than a first predetermined value, and configured to display an indication prompting adjustment of a temperature or humidity when the humidity detection unit detects a humidity exceeding a second predetermined value greater than the first predetermined value; and a winding unit configured to wind the medium, onto which a liquid is discharged from the discharge unit, in a rolled form, wherein the display control unit displays an indication prompting change of the length of the job to be executed by the discharge unit and the transport unit, when the humidity detection unit detects a humidity exceeding the second predetermined value and when a diameter of the medium in a rolled form is not less than a fourth predetermined value.

5. The liquid discharge apparatus according to claim 4, wherein the indication prompting change of the length of the job is an indication prompting setting a total job length for all of jobs to be less than a fifth predetermined value, the jobs being executed by the discharge unit and the transport unit to wind the medium into a rolled form around the winding unit.

6. A display control method for a liquid discharge apparatus including a transport unit configured to transport a medium, a discharge unit configured to discharge a liquid onto the medium, and a humidity detection unit configured to detect a humidity, the liquid discharge apparatus displaying information corresponding to the humidity, the display control method comprising:

a humidity detection step for detecting a humidity by the humidity detection unit;

a first display step for displaying an indication prompting adjustment of a temperature or humidity when the humidity detection unit detects a humidity less than a first predetermined value; and a second display step for displaying an indication prompting adjustment of a temperature or humidity when the humidity detection unit detects a humidity exceeding a second predetermined value greater than the first predetermined value, wherein when the humidity detection unit detects a humidity less than the first predetermined value, the display control unit displays an indication prompting a user to set a length of a job, that is to be executed by the discharge unit and the transport unit, to be less than a third predetermined value.

* * * * *